US005157387A

United States Patent [19]

Momose et al. .

[11] Patent Number: 5,157,387

[45] Date of Patent: Oct. 20, 1992

[54] METHOD AND APPARATUS FOR ACTIVATING A LIQUID CRYSTAL DISPLAY

[75] Inventors: Yoichi Momose; Yoichi Sakurai; Yoichi Imamura, all of Suwa, Japan

[73] Assignee: Seiko Epson Corporation, Tokyo, Japan

[21] Appl. No.: 403,510

[22] Filed: Sep. 6, 1989

[30] Foreign Application Priority Data

| | | | |
|---|---|---|---|
| Sep. 7, 1988 | [JP] | Japan | 63-223701 |
| Sep. 7, 1988 | [JP] | Japan | 63-223716 |
| Oct. 11, 1988 | [JP] | Japan | 63-255242 |
| Nov. 2, 1988 | [JP] | Japan | 63-277906 |

[51] Int. Cl.[5] ..... G09G 3/36

[52] U.S. Cl. ..... 340/784; 340/805

[58] Field of Search ..... 340/784, 805; 350/333, 350/332, 330; 359/54, 55, 57

[56] References Cited

U.S. PATENT DOCUMENTS

| | | | |
|---|---|---|---|
| 4,180,813 | 12/1979 | Yoneda | 340/784 |
| 4,586,039 | 4/1986 | Nonomura et al. | 340/784 |
| 4,626,841 | 12/1986 | Togashi | 340/784 |
| 4,656,470 | 4/1987 | Saka | 340/784 |
| 4,730,140 | 3/1988 | Masubuchi | 340/784 |
| 4,857,906 | 8/1989 | Conner | 340/784 |
| 4,906,984 | 3/1990 | Tukeda et al. | 340/784 |
| 4,926,168 | 3/1990 | Yamamoto et al. | 340/784 |
| 4,945,352 | 7/1990 | Ejiri | 340/784 |

FOREIGN PATENT DOCUMENTS

| | | |
|---|---|---|
| 0071911 | 2/1983 | European Pat. Off. . |
| 0272079 | 6/1988 | European Pat. Off. . |
| 2067332 | 7/1981 | United Kingdom . |

OTHER PUBLICATIONS

"A Pocket-Size Liquid-Crystal TV Display", by E. Kaneko, et al., Proceedings of the SID, vol. 23, I. 1982, pp. 3–8.

*Primary Examiner*—Jeffery A. Brier
*Assistant Examiner*—Regina Liang
*Attorney, Agent, or Firm*—Blum Kaplan

[57] ABSTRACT

A method and circuit for activating a liquid crystal matrix display panel in which during each selecting period, each liquid crystal cell pixel of the matrix, whether selected or unselected, receives either a primary selecting signal voltage or non-selecting signal voltage as well as an additional different secondary voltage to generate substantially homogeneous cross-talk noise over the entire display. The signal voltage applied to a pixel during a selecting period can vary between a primary selecting or non-selecting voltage applied for a first time interval followed by or preceded by a secondary voltage intermediate the selecting and non-selecting voltage applied for a second interval. Alternatively, the primary signal voltage applied to the pixel for a first time interval can be a selecting or non-selecting voltage and secondary voltage applied for a second time interval can be the other. In another embodiment of the invention, the relative duration of the primary and secondary voltages affects the darkness gradation of the display.

51 Claims, 19 Drawing Sheets

FIG. 1(a)
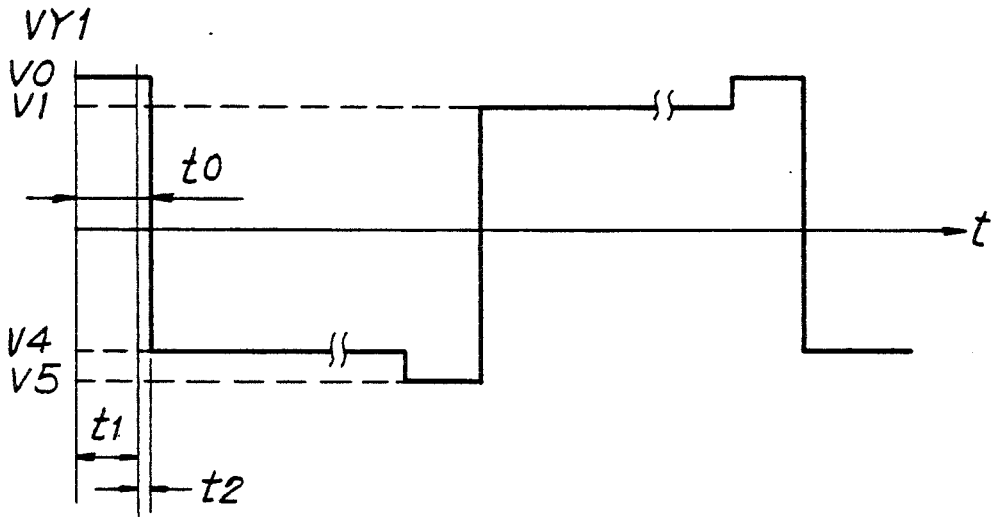
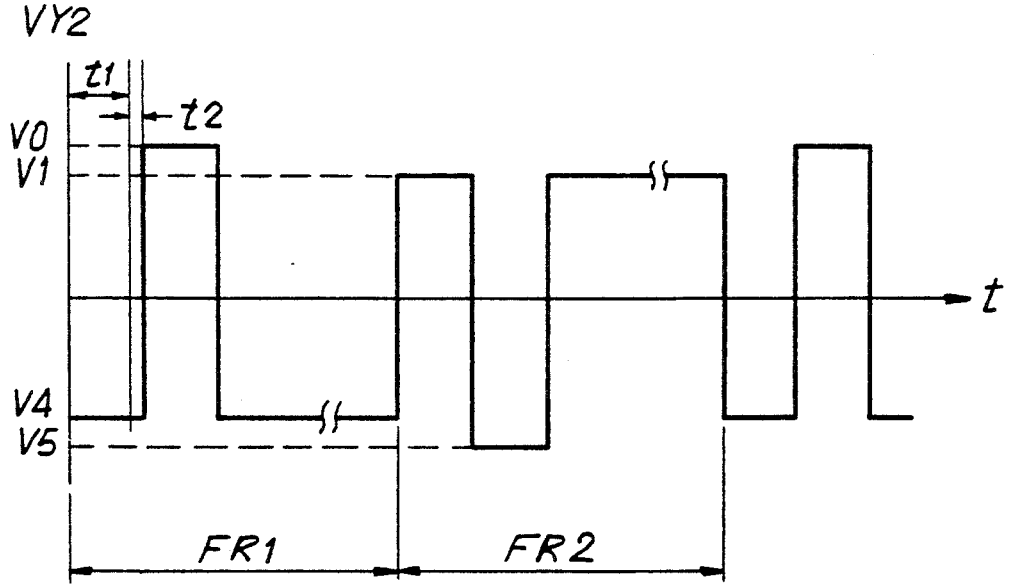
FIG. 1(b)

FIG. 2(a)
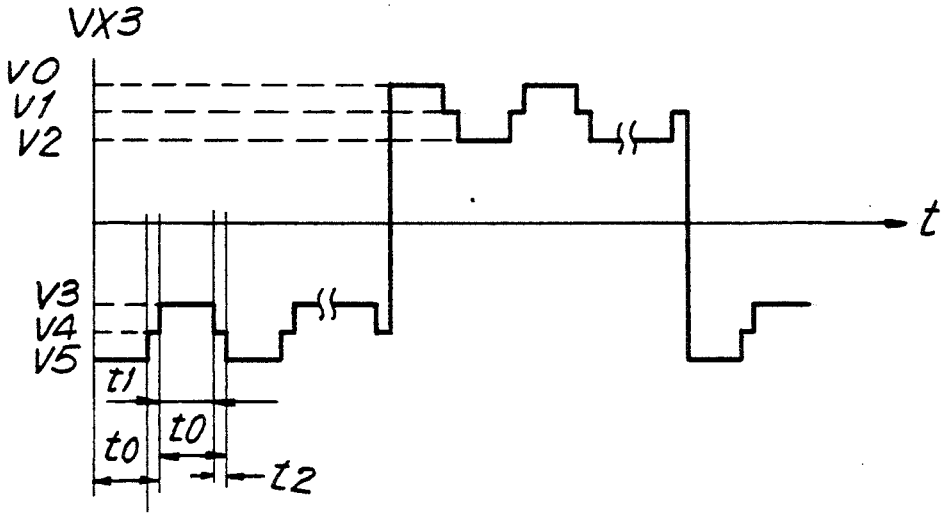
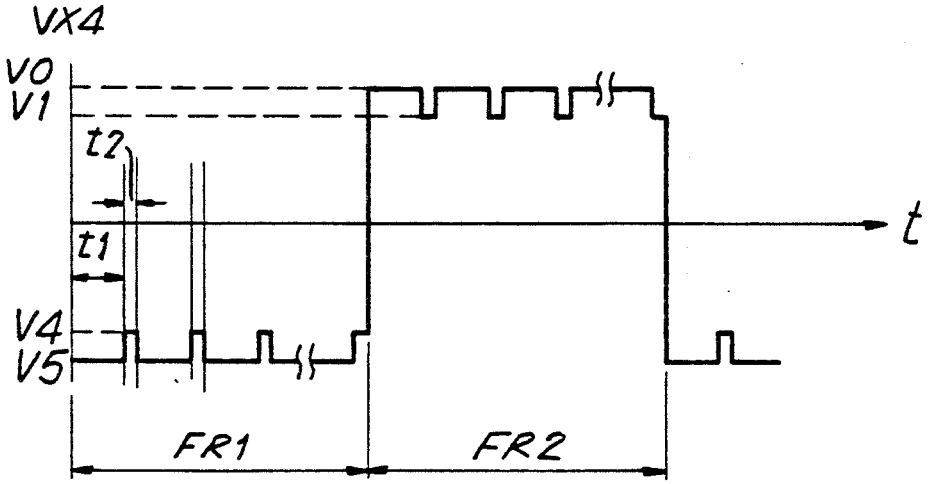
FIG. 2(b)

ONE FRAME

FR
1H

LP

SEG
V0
V2
V3
V5

COM
V0
V1
V4
V5

LP

RES
Δt1
Δt2
Δt1

GCP

U/D

GRAY LEVEL (DISPLAY DATA)
0(H)
FULLY OFF

1(H)

2(H)

3(H)

4(H)

5(H)
V0
V2

6(H)

7(H)
FULLY ON

FIG. 20(a)
PRIOR ART
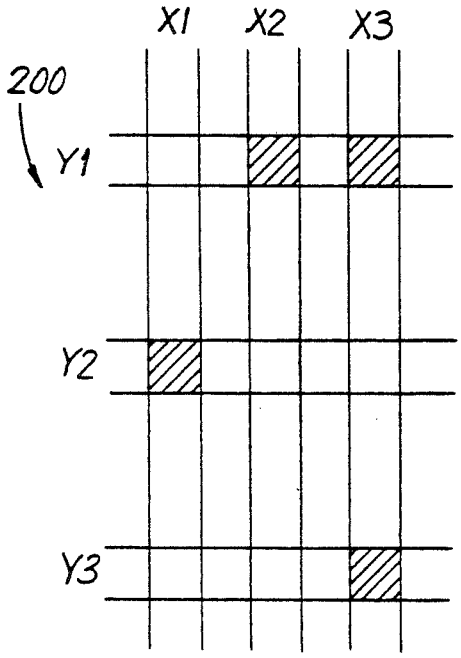
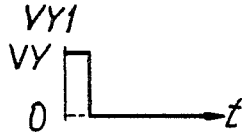
FIG. 20(b)
PRIOR ART
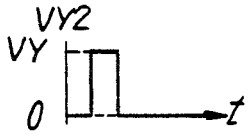
FIG. 20(c)
PRIOR ART
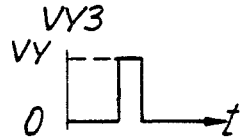
FIG. 20(d)
PRIOR ART
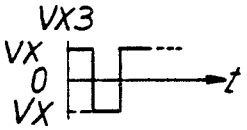
FIG. 20(e)
PRIOR ART
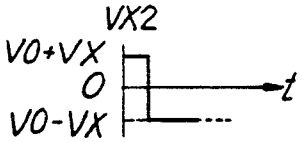
FIG. 20(f)
PRIOR ART
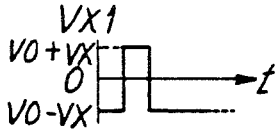
FIG. 20(g)
PRIOR ART

VX1
-VX1
70

VX2
-VX2

71
VX3
-VX3

72

METHOD AND APPARATUS FOR ACTIVATING A LIQUID CRYSTAL DISPLAY

BACKGROUND OF THE INVENTION

This invention relates generally to a method and apparatus for activating a liquid crystal display and, in particular, to a method and apparatus for making essentially uniform its crosstalk noise throughout the entire liquid crystal display to provide a display having uniform contrast and brightness regardless of the pattern of the display.

A conventional liquid crystal display matrix 200 is shown schematically in FIG. 20(*a*) and a conventional method for activating the display is shown in the timing diagrams of FIGS. 20(*b*)-20(*g*). Liquid crystal display 200 is formed with signal electrodes X1, X2 and X3 and scanning electrodes Y1, Y2 and Y3 orthogonal to the signal electrodes. Liquid crystal pixels are present at intersections of scanning electrodes and signal electrodes. A pixel at the intersection of scanning electrode Y2 and signal electrode X3 will be referred to a pixel Y2X3 for convenience. Cross hatched intersections of scanning electrodes and signal electrodes represent unselected pixels and unhatched intersections of scanning electrodes and signal electrodes represent selected pixels.

The scanning voltage, non-selecting voltage and selecting voltage are denoted VY, VX and −VX respectively. The waveforms of voltages applied to signal electrodes X1, X2 and X3 are represented by VX1, VX2 and VX3 respectively in FIGS. 20(*g*), 20(*f*) and 20(*e*) respectively. The waveforms of voltages applied to scanning electrodes Y1, Y2 and Y3 are represented by VY1, VY2 and VY3 respectively in FIGS. 20(*b*), 20(*c*) and 20(*d*) respectively.

A selecting period is the duration for which the selecting voltage is applied to a scanning electrode. During a first selection period, signal electrode Y1 is selected and scanning voltage VY is applied to electrode Y1. N voltage is applied to electrodes Y2 and Y3. To select a pixel at the intersection electrodes Y1 and X1, a selecting voltage −VX is applied to electrode X1 during the first selecting period. The pixels at the intersection of electrodes X2 and X3 with scanning electrode Y1 are to be unselected. Consequently, a non-selecting voltage VX is applied to these electrodes during the first selecting period.

The effective voltage applied to each pixel is equal to the difference between the voltage applied to the corresponding scanning electrode and the voltage applied to the corresponding signal electrode. Accordingly, a voltage of VY+VX (VY−(−VX)) is applied to the pixel at the intersection of signal electrode X1 and scanning electrode Y1 during the first selecting period. A voltage of VY+VX is of sufficient magnitude to activate a liquid crystal pixel. During the same selection period, voltage is not applied to scanning electrodes Y2 and Y3 and therefore pixels intersecting these electrodes will have a voltage of VX or −VX. The voltages are selected so that VY−VX is of insufficient magnitude to activate the liquid crystal pixel.

During the next selecting period, pixels Y2X2 are selected. Scanning electrode Y2 receives a selecting voltage VY and scanning electrodes Y1 and Y3 do not. A non-selecting voltage VX is applied to electrode Xl and a selecting voltage −VX is applied to electrodes X2 and X3. The applied voltage at the intersection of electrodes X2 and X3 with electrode Y2, will be VX+VY and pixels Y2X2 and Y2X3 at those intersections will be selected. Because a voltage of VY−VX is insufficient to activate the liquid crystal cells at intersections of scanning electrodes and signal electrodes, but a voltage of VX +VY is sufficient, only liquid crystal cell pixels at selected positions will become visible.

The method of operation during the third selecting when scanning electrode Y3 is selected is the same as with scanning electrodes Y1 and Y2. Pixels Y3X1 and Y3X2 are to be selected and signal electrodes X1 and X2 are at −VX. Pixel Y3X3 is to be unselected and the voltage at the intersection of scanning electrode Y3 and signal electrode X3 will have a voltage VY−VX which is insufficient to activate the liquid crystal pixel at that intersection and pixel Y3X3 will be unselected.

When a liquid crystal display matrix having a large area which can include hundreds of signal electrodes and scanning electrodes is activated by this conventional technique, undesirable crosstalk occurs between the scanning and signal electrodes. Crosstalk is caused by capacitance between the scanning and signal electrodes as well as the resistance of the wiring. Crosstalk noise from several sources on a single electrode can cancel out or increase in magnitude depending on the particular pattern of the matrix to be displayed at a portion of the panel and can change the effective value of voltage applied to different portions of the liquid crystal cell which affects the display characteristics, such as contrast ratio and brightness of the display. The localized difference in the effects of crosstalk lead to localized contrast variations of the liquid crystal display and therefore deteriorate the quality of the display.

As noted above, when a pixel is selected, it receives scanning voltage VY and selecting voltage −VX. When the pixel is not selected, voltage VX is applied. Referring to FIGS. 21(*a*) and 21(*b*), when the signal voltage at signal electrode X1 changes from −VX to VX or from VX to −VX, noise 70 and 70' is produced respectively at a scanning electrode as a result of capacitive coupling between the scanning electrode and the signal electrode. This will adversely affect the value of voltage applied to pixels by the scanning electrode. The magnitude of the noise generated when a signal pixel switches between selected and unselected voltage is substantially the same throughout the display provided that the electrodes have uniform resistance and that the capacitance between the electrodes is uniform. Accordingly, if the pixels are all uniformly switching between selecting and non-selecting voltages, the generation of noise will be uniform throughout the display and the quality of the display will be uniform and acceptable.

While the signal voltage at electrode X1 produces a noise 70 at a scanning electrode intersecting signal electrode X1, a wave form of voltage applied to signal electrode X2 can induce a noise 71 shown in FIG. 21(*d*) at the same scanning electrode as shown in FIG. 21(*c*). Further, a waveform shown in FIG. 21(*e*), applied to signal electrode X3 can induce a noise 72, shown in FIG. 21(*f*), in the same scanning electrode. The noise generated from signal electrodes to a scanning electrode will be the sum of the noises produced by the signal electrodes intersecting that scanning electrode.

Depending on the pattern of liquid crystal pixels to be selected over a given time interval, the noise can have different effects at different localized portions of the display. For example, if noise 70 and noise 71 are generated in the same scanning electrode, they will cancel out as shown in FIG. 21(*g*). If noise 70 and noise 72 are generated in the same scanning electrode, they will superimpose on each other to produce a noise of increased magnitude. Accordingly, because noise is generated differently at different portions of the same display, crosstalk will lead to localized contrast variations and an unsuitable display.

Conventional liquid crystal display activating methods therefore have inadequacies due to these shortcomings. Accordingly, it is desirable to provide an improved method of activating a liquid crystal display which avoids the shortcomings of the prior art and provides clear uniform displays that lack localized contrast variations caused by crosstalk.

SUMMARY OF THE INVENTION

Generally speaking, in accordance with the present invention, a method of activating a liquid crystal matrix panel is provided in which during each selecting period, each liquid crystal cell pixel of the matrix, whether selected or unselected, receives either a primary selecting signal voltage or a primary non-selecting signal voltage as well as an additional different secondary voltage to generate substantially homogeneous crosstalk noise over the entire display. The signal voltage applied to a pixel during a selecting period can vary between a primary selecting or non-selecting voltage applied for a first time interval followed by or preceded by a secondary voltage intermediate the selecting and non-selecting voltage applied for a second interval. Alternatively, the primary signal voltage applied to the pixel for a first time interval can be a selecting or non-selecting voltage and the secondary voltage applied for a second time interval can be the other. In an embodiment of the invention, the second interval is shorter than the first interval. In another embodiment of the invention, the secondary voltage of the second interval precedes or follows the primary voltage, depending on whether the primary voltage is a selecting voltage or non-selecting voltage. In still another embodiment of the invention, the selective relative duration of the primary and secondary voltages affects the darkness gradation of the display.

Accordingly, it is an object of the invention to provide an improved method for driving a liquid crystal display.

Another object of the invention is to provide an improved circuit for driving a liquid crystal display.

A further object of the invention is to provide an improved method and circuit for driving a liquid crystal display panel in which crosstalk noise is substantially uniform throughout the display and the display lacks localized contrast variations.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 1(*a*) and 1(*b*) diagrams showing waveforms of scanning voltages applied to scanning electrodes of a liquid crystal display in accordance with the invention;

FIGS. 2(*a*) and 2(*b*) are timing diagrams showing the waveforms of signal voltages applied to signal electrodes of a liquid crystal display in accordance with a first embodiment of the invention;

FIGS. 5(*b*) and 5(*d*) show the crosstalk noise sent from a signal electrode to a scanning electrode generated by the signal voltage waveforms of FIGS. 5(*a*) and 5(*c*) respectively;

FIGS. 6(*b*) and 6(*d*) illustrate the crosstalk noise generated by the signals of FIGS. 6(*a*) and 6(*c*) respectively when a liquid crystal panel is activated by a conventional method;

FIGS 8(*c*) and 8(*d*) are waveforms of voltages output from the circuit shown in FIG. 7;

FIGS. 11(*a*) and 11(*d*) show the crosstalk noise generated from a signal electrode to a scanning electrode when a liquid crystal display is activated as shown in FIGS. 11(a) and 11(c) respectively, in accordance with a second embodiment of the invention;

FIGS. 13(*c*) and 13(*d*) show waveforms of voltages output to signal electrodes from the circuit shown in FIG. 12 in accordance with a second embodiment of the invention;

FIGS. 16(*c*) and 16(*d*) are waveforms of voltages output to signal electrodes from the circuit shown in FIG. 12 in accordance with a third embodiment of the invention;

FIG. 20(*a*) is a schematic diagram of a conventional liquid crystal display;

FIGS. 20(*b*), 20(*c*) and 20(*d*) are timing diagrams showing the waveforms for driving scanning electrodes of the display of FIG. 20(*a*) in accordance with a conventional liquid crystal display activation method;

FIGS. 20(*e*), 20(*f*) and 20(*g*) are timing diagrams of waveforms for driving signal electrodes of the display of FIG. 20(*a*) in accordance with a conventional liquid crystal activation method;

FIGS. 21(*b*), 21(*d*) and 21(*f*) are waveforms showing noise generated from the signal voltage waveforms shown in FIGS. 21(*a*), 21(*c*) and 21(*e*) respectively; and FIGS. 21(*g*) and 21(*h*) show effective noise waveforms resulting from combined noise of FIGS. 21(*b*) and 21(*d*) and of 21(*b*) and 21(*f*), respectively.

DETAILED DESCRIPTION OF THE PREFERRED EMBODIMENTS

Figure 4:
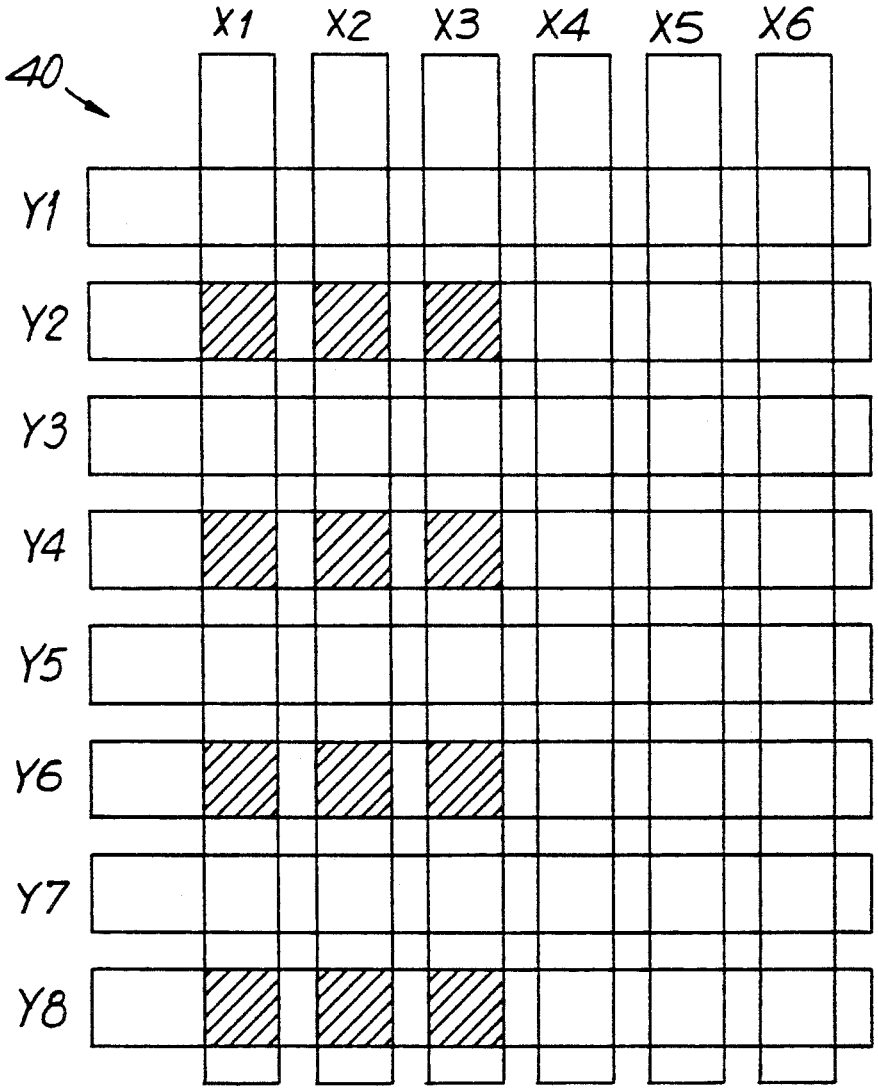
FIG. 4 is a schematic diagram of a liquid crystal display including scanning electrodes and signal electrodes formed in accordance with the invention.
Figure 5A:
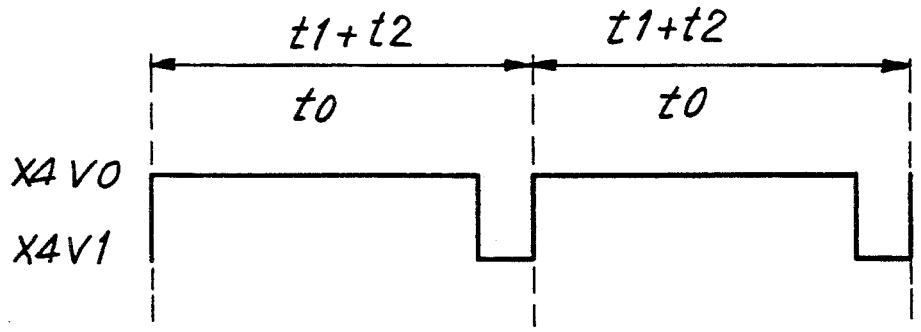
FIGS. 5(*a*) and 5(*c*) are timing diagrams showing the waveforms of signal voltages applied to signal electrodes X4 and X3 of the display of FIG. 4 in accordance with a first embodiment of the invention.
Figure 5B:
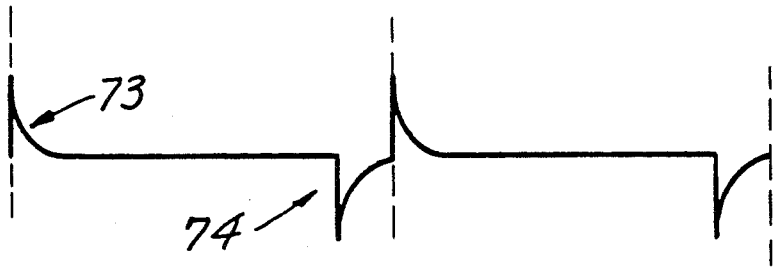
Figure 5C:
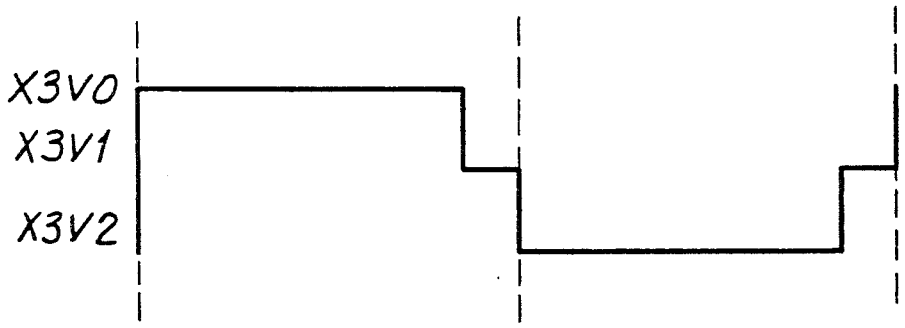
Figure 5D:
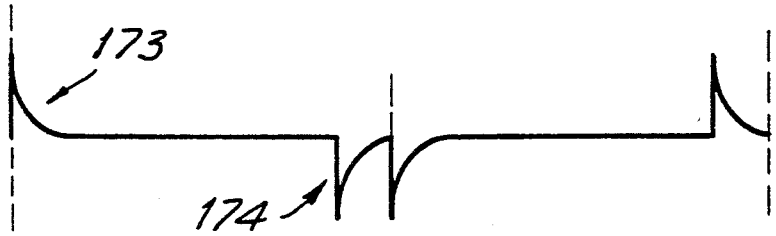
Figure 6A:
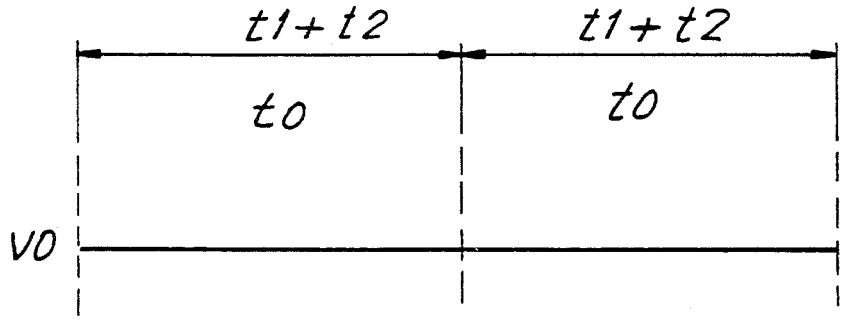
FIG. 6(a) PRIOR ART
FIGS. 6(*a*) and 6(*c*) are timing diagrams showing the waveform of a conventional signal voltage.
Figure 6B:
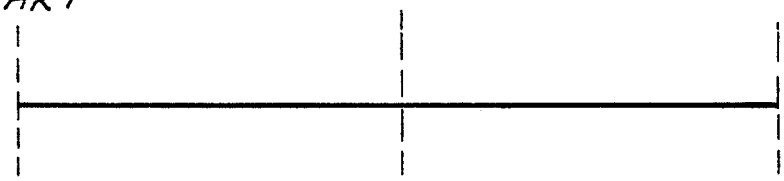
FIG. 6(b) PRIOR ART
Figure 6C:
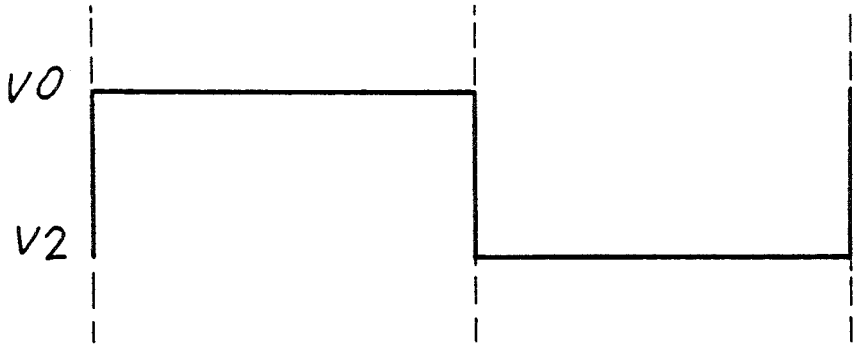
FIG. 6(c) PRIOR ART
Figure 6D:
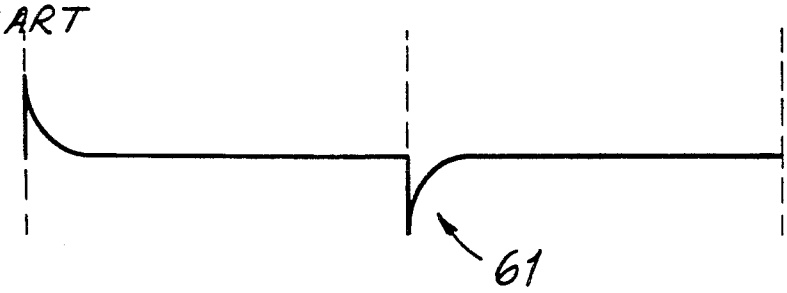
FIG. 6(d) PRIOR ART

A schematic plan view of a liquid crystal display panel 40 is shown generally in FIG. 4. Display 40 is formed of a first base sheet including a series of scanning electrodes Y1 through Y8 formed thereon and a second base sheet including signal electrodes X1 through X6 formed thereon, orthogonal to the scanning electrodes. A layer of liquid crystal material is disposed between the two base sheets.

Liquid crystal pixels are formed at intersections of scanning electrodes and signal electrodes. A pixel located at the intersection of a scanning electrode such as Y2 and a signal electrode such as X3 will be referred to as pixel Y2X3 herein. To activate a liquid crystal panel in accordance with the invention, a scanning voltage is applied successively to the scanning electrodes for successive selecting periods and a selecting voltage is applied to signal electrodes intersecting the selected scanning electrode and selected pixels for a first time interval of the selecting period. A non-selecting voltage is applied to signal electrodes intersecting unselected pixels for a first time interval of the selecting period.

To provide homogeneous crosstalk noise throughout the display, the voltage applied to each signal electrode is varied at least once during each selecting period. A primary voltage establishes the visual condition of the pixel and a secondary voltage during the selecting period provides crosstalk noise during each selecting period at each pixel. If a pixel is selected, it receives a selecting scanning voltage during a selecting period. The pixel also receives a primary selecting signal voltage for a portion of the selecting period as well as a secondary voltage having a different magnitude than the primary selecting voltage for another interval of the selecting period. If the pixel is to be unselected, the signal electrode intersecting the pixel receives a primary non-selecting voltage for a portion of the selecting period and a secondary voltage of different magnitude for another portion of the selecting interval. In this manner, localized contrast variations due to localized noise variations are suppressed.

Several embodiments of the invention will be explained in detail with reference to the following examples. The examples are presented for purposes of illustration only and are not intended to be construed in a limiting sense. Each example describes activation of a liquid crystal display that has 640 signal electrodes and 200 scanning electrodes. However, for convenience, the examples will be explained with reference to display 40 of FIG. 4 which can be considered to be a portion of the entire display, wherein hatched intersections of signal and scanning electrodes represent unselected pixels and unhatched intersections represent selected pixels.

EXAMPLE 1

Figure 3A:
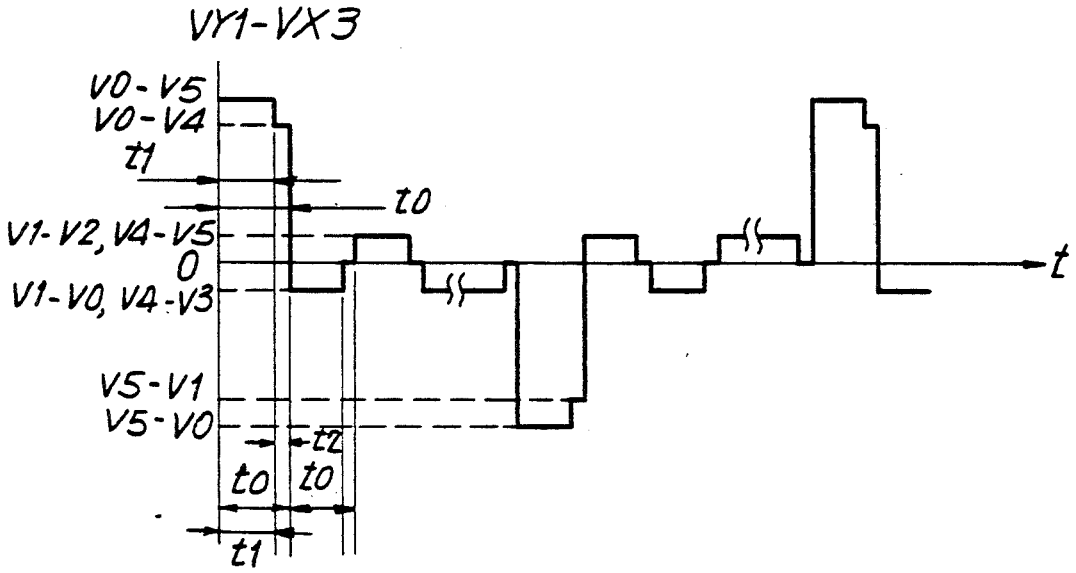
FIGS. 3(*a*) and 3(*b*) are timing diagrams showing the waveforms of combined scanning voltages of FIGS. 1(*a*) and 1(*b*) and signal voltages of FIGS. 2(*a*) and 2(*b*) applied to liquid crystal pixels of a liquid crystal display in accordance with a first embodiment of the invention.
Figure 3B:
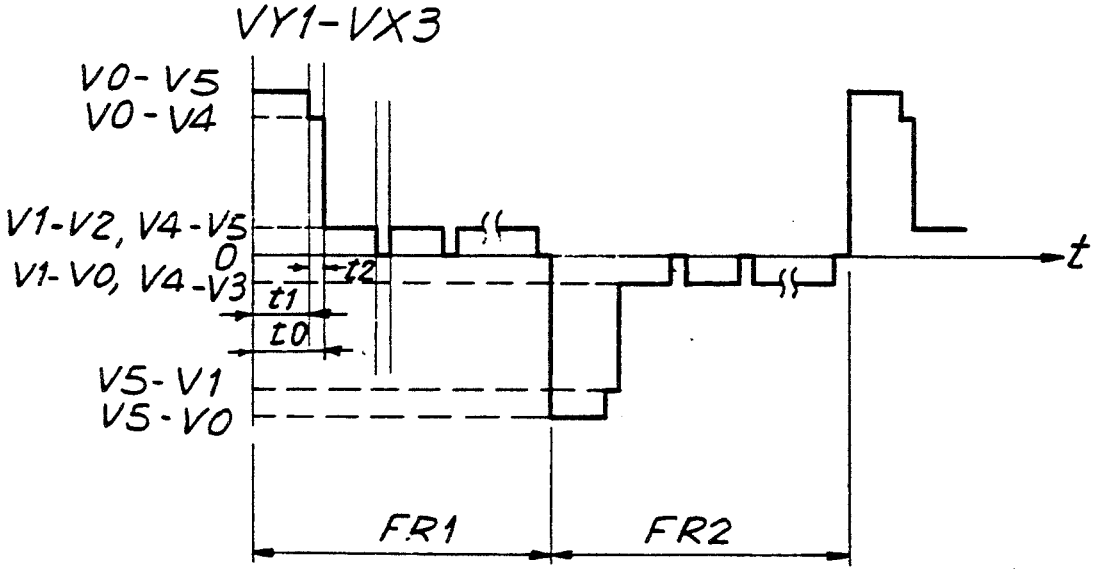

FIGS. 1(*a*) and 1(*b*) are timing diagrams showing the waveform of scanning voltage applied to scanning electrode Y1 and Y2 respectively. FIGS. 2(*a*) and 2(*b*) are timing diagrams showing the waveforms of signal voltages applied to signal electrodes X3 and X4 respectively in accordance with a first embodiment of the invention. FIGS. 3(*a*) and 3(*b*) are timing diagrams showing the waveform of combined scanning and signal voltages applied to pixels Y1X3 and Y1X4 respectively.

The selecting period t0 is equal to 70 μsec and is equal to each successive scanning period. The selecting period corresponding to the signal electrodes is formed of a first signal interval t1=60 μsec followed by a second signal interval t2=10 μsec. In FIGS. 1(*a*), 1(*b*), 2(*a*), 2(*b*), 3(*a*) and 3(*b*), V0−V1=V1−V2=V3−V4=V4−V5=1.51 V and V2−V3=14.16 V.

Referring to FIGS. 1(*a*) and 1(*b*), a scanning voltage V0 is applied to scanning electrode Y1 for first selecting period t0. Thereafter, a non-selecting voltage V4 is applied to scanning electrode Y1 for the remainder of period FR1 while each remaining scanning electrode is selected for one selecting period t0 in succession. For example, as voltage Y1 changes from V0 to V4 at the end of first selecting period t0, scanning electrode Y2 receives a scanning voltage V0 for a period t0.

At the end of period FRI, the selecting voltage for the scanning electrodes is V5 and the non-selecting voltage is V1. Accordingly, at the beginning of period FR2, a selecting voltage of V5 is applied to scanning electrode Y1. At the end of each frame, the voltage applied to the liquid crystal display reverses in polarity while maintaining the same magnitudes of voltages to provide the display with certain commonly known benefits which will not be detailed herein.

Referring to FIGS. 2(*a*) and 2(*b*), during each scanning period t0, the signal electrodes receive a primary selecting voltage V5 or a primary non-selecting voltage V3 for a first interval t1 followed by an intermediate voltage V4 for a second interval t2. During period FR2, the selecting voltage is V0, the non-selecting voltage is V2 and the intermediate reference voltage is V1.

As shown in FIG. 2(*b*), even though signal electrode X4 is selected throughout period FR1, the voltage changes from selecting voltage V5 to reference voltage V4 for interval t2 following each interval t1. Referring to FIG. 2(*a*), during the first selecting period, signal electrode X3 is selected. Accordingly, it receives a primary selecting voltage V5 for first interval t1 followed by a secondary reference voltage V4 for second interval t2. During the second selecting period t0, signal electrode X3 is not selected and receives a primary non-selecting voltage V3 for first interval t1 followed by a secondary reference voltage for second interval t2.

Referring to FIGS. 3(*a*) and 3(*b*), the voltage at each pixel will be equal to the difference between the scanning voltage VY and the signal voltage VX (VY−VX). As shown in FIG. 2, during period FR1, either a selecting voltage V5 or a non-selecting voltage V3 is applied to each signal electrode during each first interval t1. During each second interval t2, intermediate reference voltage V4 is applied to the signal electrode. Therefore, during each non-selecting period of a scanning electrode, when a signal electrode is selected, the primary voltage at the pixel (VY−VX) is equal to V4−V5 during first interval t1 and 0 (V4−V4) during second interval t2. When signal electrode is not selected, the primary voltage at the intersection pixel is equal to V4−V3 during first interval t1 and 0 during second interval t2.

As noted above, during period FR2 the voltages activating the liquid crystal panel are reversed. The selecting voltage for the scanning electrodes is V5 and the non-selecting voltage is V1. The selecting voltage for the signal electrodes is V0, the intermediate reference voltage applied during second interval t2 is V1 and the non-selecting voltage is V2. Accordingly, as shown in FIGS. 3(*a*) and 3(*b*), during period FR2, non-selected pixels will have a primary voltage V1−V2 during first interval t1 and 0 during second interval t2. Selected pixels will have a primary voltage V5 −V0 during first interval t1 and V5−V1 during second interval t2.

A pixel becomes visible when the magnitude of the effective voltage (VY−VX) applied to the pixel exceeds the magnitude of the threshold voltage of the liquid crystal. A pixel will remain visible if the applied voltage exceeds the threshold voltage is then decreased to not less than the threshold voltage. Likewise, a non-selected pixel will not become visible if the magnitude of the applied voltage is increased to not more than the threshold voltage.

In accordance with the invention, the pixels do not receive a constant voltage during each selecting period t0. The selecting signal voltage is lowered during second interval t2 and the non-selecting signal voltage is raised during second interval t2. However, the voltage decrease from V0−V5 to V0−V4 or from V5−V0 to V5−V1 during interval t2 is insufficient to deactivate an activated pixel. Likewise, the increase from V1−V0, V4−V3, V1−V2 or V4−V5 to 0 is insufficient to activate an unselected pixel.

FIGS. 5(*a*) through 5(*d*) are timing diagrams showing the generation of crosstalk noise during activation of liquid crystal panel 40 in accordance with the invention. FIG. 5(*a*) shows the waveform of voltage applied to signal electrode X from the start of period FR2 during which period, signal electrode X4 remains selected FIG. 5(*b*) shows a crosstalk noise 73 and 74 produced at pixel X4Y1 from a signal electrode to a scanning electrode. FIG. 5(*c*) shows the waveform of voltage applied to signal electrode X3 at the beginning of period FR2 in which the pixel changes from a selected to an unselected condition. FIG. 5(*d*) shows the waveform of a crosstalk noise 173 and 174 produced at pixel X3Y1 and sent from a signal to a scanning electrode.

FIGS. 6(*a*) through 6(*d*) illustrate the crosstalk noise sent from a signal electrode to a scanning electrode when a liquid crystal display 40 is activated in accordance with a conventional method. FIG. 6(*a*) shows the waveform of a voltage applied to select signal electrode X4 through two successive selecting periods t0. FIG. 6(*b*) shows the waveform of crosstalk noise produced at pixel X4Y1 from a signal to a scanning electrode. FIG. 6(*c*) shows the conventional waveform of voltage applied to signal electrode X3 to change the voltage from selecting voltage V0 to non-selecting voltage V2. FIG. 6(*d*) shows a crosstalk noise 61 produced at pixel X3Y1 and sent from a signal to scanning electrode.

As shown in FIGS. 6(*b*) and 6(*d*), when the prior art method is employed to produce the same pattern produced by the waveforms of FIGS. 5(*a*) and 5(*c*), crosstalk produced along signal electrode X4 which corresponds to successive selected pixels and signal electrode X3 which corresponds to an alternated selected and unselected pixel, the manner in which crosstalk noise is sent from the signal electrode to the scanning electrode is different. Accordingly, pixels X3Y1 and X4Y1 will differ in transmittance.

As shown in FIGS. 5(*b*) and 5(*d*), when a method in accordance with the invention is used to activate the pixels, the manner in which crosstalk noise is sent from a signal electrode to a scanning electrode does not differ whether successive selected pixels or alternating selected and unselected pixels are arranged on a signal electrode. The magnitude of noise 73 is equal to noise 173 and the magnitude of a noise 74 is equal to that of a noise 174. Accordingly, because each selecting period t0 includes a noise equal to noise 73 and a noise equal to noise 74 regardless of the arrangement of selected and unselected pixels, the noise will be uniform throughout the display and the pixels, such as pixel X3Y1 and X4Y1 will have substantially identical transmittance.

Figure 7:
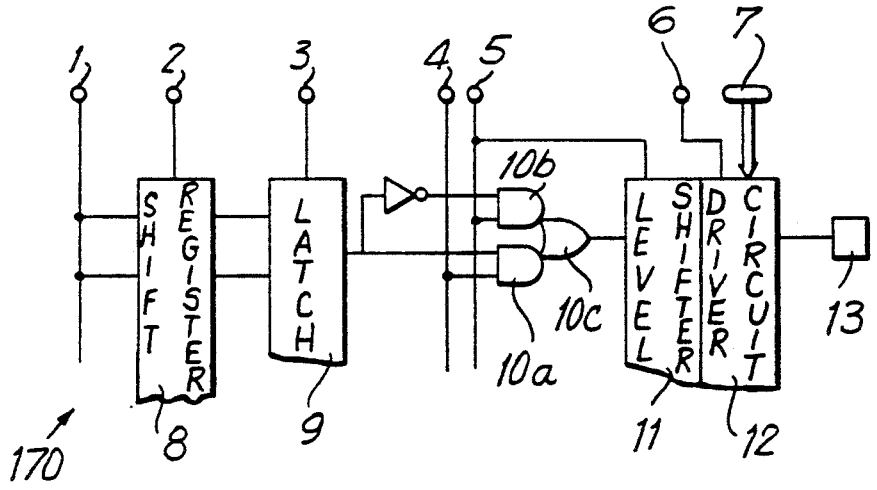
FIG. 7 is a diagram of a circuit for activating a signal electrode in accordance with the invention.
Figure 8A:
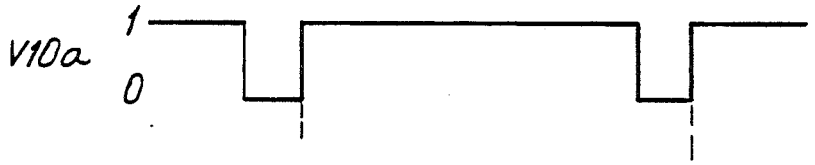
FIGS. 8(*a*) and 8(*b*) are timing diagrams of waveforms of voltages input to terminals 4 and 5 respectively of the circuit shown in FIG. 7.
Figure 8B:
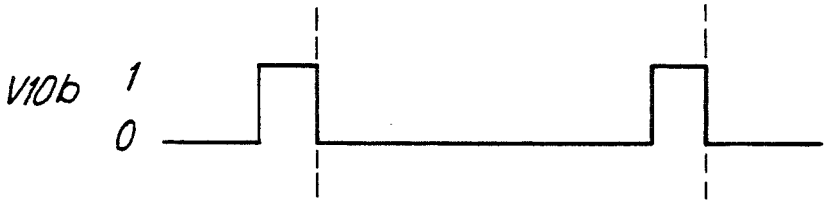
Figure 8C:
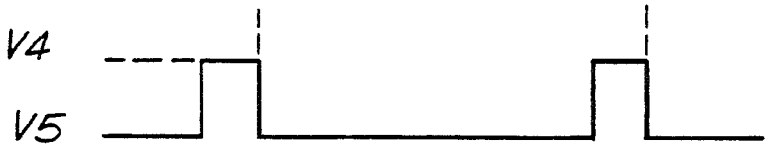
Figure 8D:
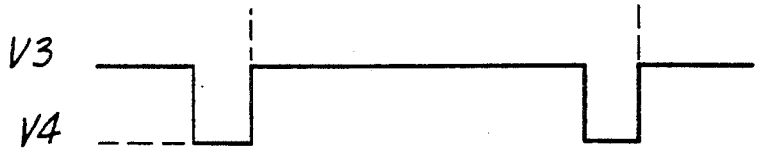

FIG. 7 is a diagram of a circuit 170 for activating a liquid crystal display in accordance with the invention. FIGS 8(*a*), 8(*b*), 8(*c*) and 8(*d*) are timing diagrams illustrating the operation of circuit 170. Circuit 170 includes a shift clock input terminal 1 and a data input terminal 2 for receiving data for determining whether or not a pixel is to be activated to provide a display, both coupled to a shift register 8 for outputting the data. A latch 9 is included to retain data received at input terminal 2 and for converting the data from shift register 8, in serial form, to a parallel form. Latch 9 is controlled by a signal at a latch signal input terminal 3.

Circuit 170 also includes a pair of signal voltage input terminals 4 and 5 connected to a pair of AND gates 10*a* and 10*b* respectively. The outputs of AND gates 10*a* and 10*b* are supplied to an OR gate 10*c*. A waveform V10*a* and a waveform V10*b*, shown in FIGS. 8(*a*) and 8(*b*) are applied to signal voltage input terminal 4 and input terminal 5, respectively. When the data retained in latch 9 is at a high level, the signal of FIG. 8(*a*) is selected. When the data in latch 9 is at a low level, the signal of FIG. 8(*b*) is selected. Accordingly, depending on the level of latch 9 the waveform of signal voltage shown in FIG. 8(*c*) is applied to selected pixels or the waveform of FIG. 8(*d*) is applied to unselected pixels during period FR1.

Circuit 170 also includes a level shifter 11 for converting the power system based on signal voltage input terminal 5 and OR gate 10*c* and a signal electrode driving circuit 12. An inverting terminal 6 for AC driving and a power source 7 for energizing a liquid crystal cell are coupled to signal electrode driving circuit 12 to provide a suitable voltage to a terminal 13 from which the signal electrodes are energized.

EXAMPLE 2

Figure 9A:
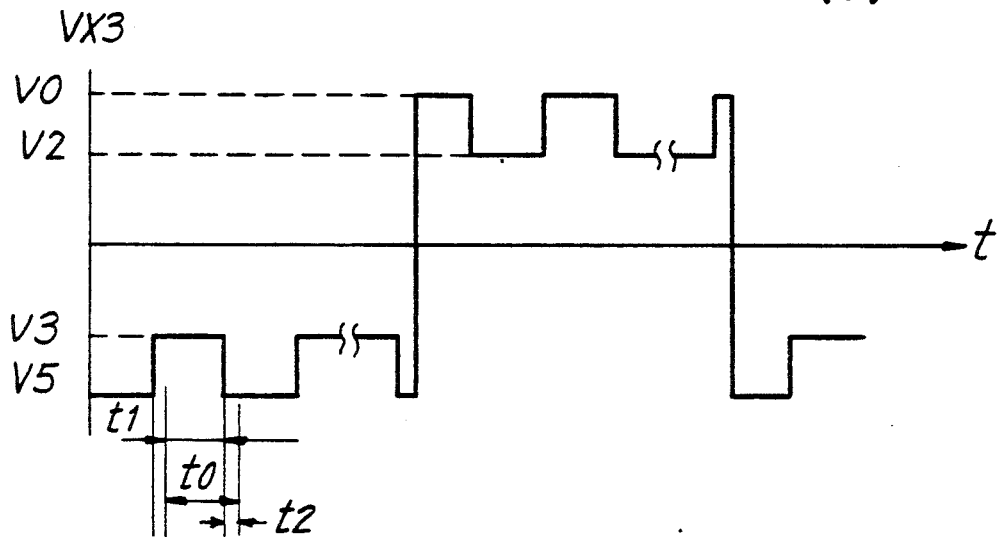
FIGS. 9(*a*) and 9(*b*) are timing diagrams showing waveforms of signal voltages applied to signal electrodes X3 and X4 of the display shown in FIG. 4 in accordance with a second embodiment of the invention.
Figure 9B:
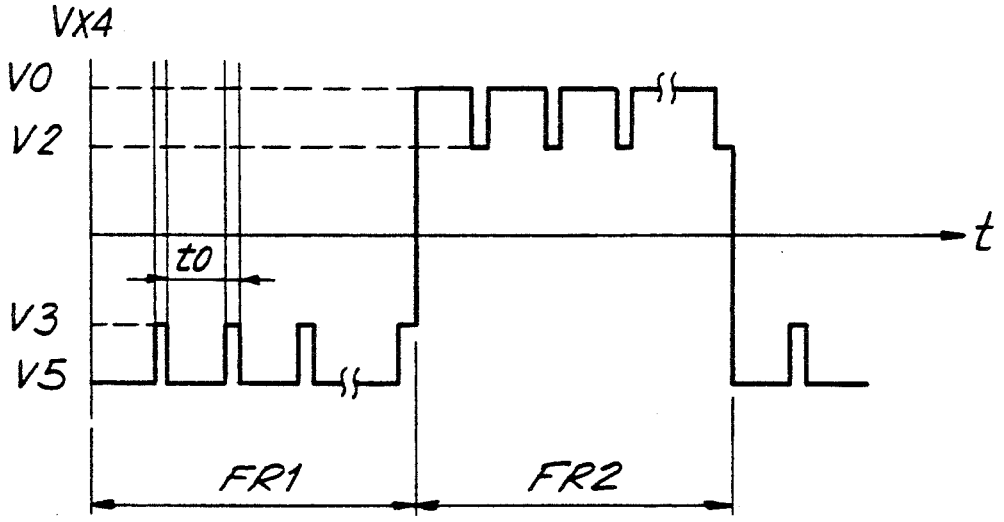
Figure 10A:
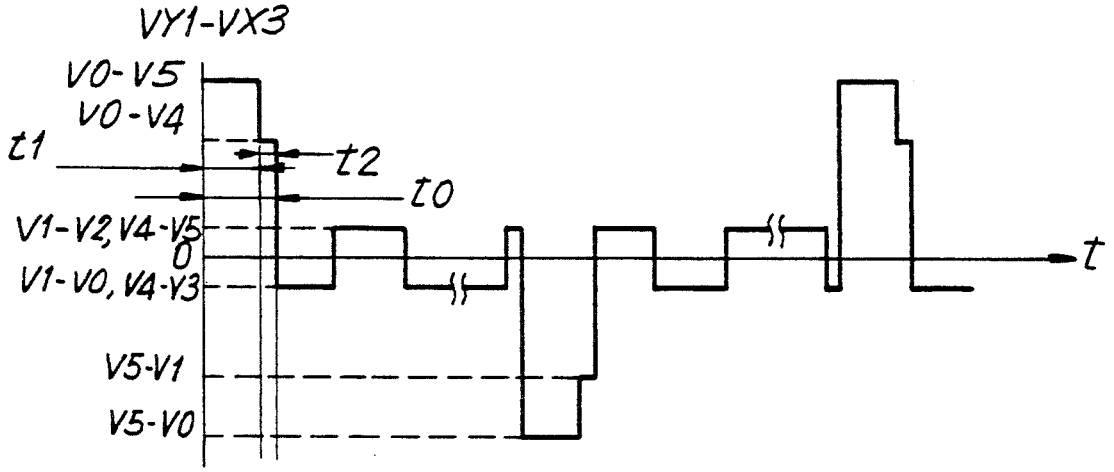
FIGS. 10(*a*) and 10(*b*) are timing diagrams showing the waveform of combined scanning voltages and signal voltages applied to pixels Y1X3 and Y1X4 of the display of FIG. 4 in accordance with a second embodiment of the invention.
Figure 10B:
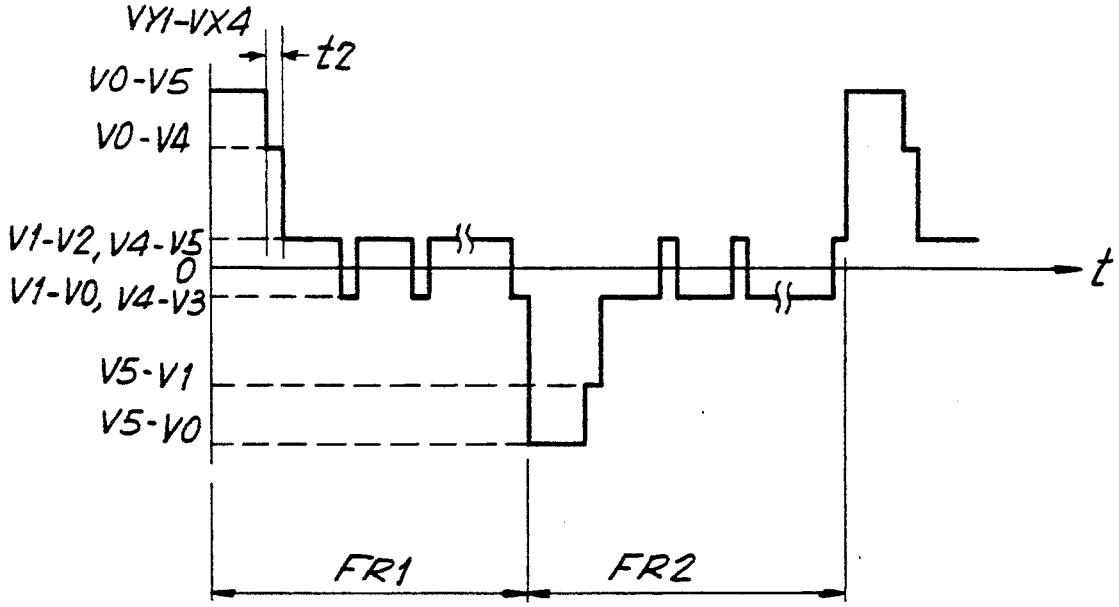
Figure 11A:
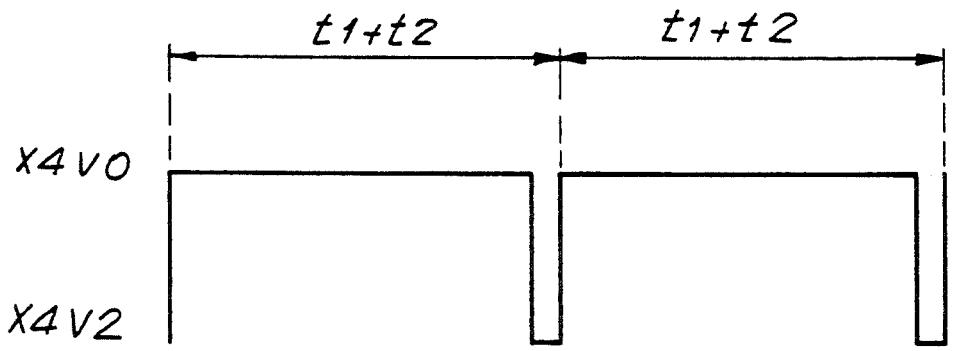
FIGS. 11(*a*) and 11(*c*) are timing diagrams showing the waveform of a voltage applied to signal electrodes when a display is operated as shown in FIGS. 9(*a*) and 9(*b*) respectively.
Figure 11B:
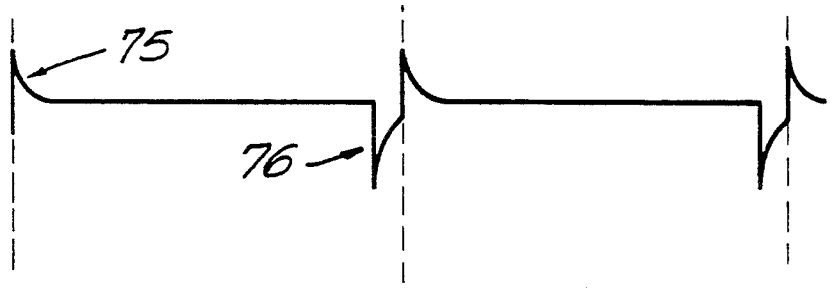
Figure 11C:
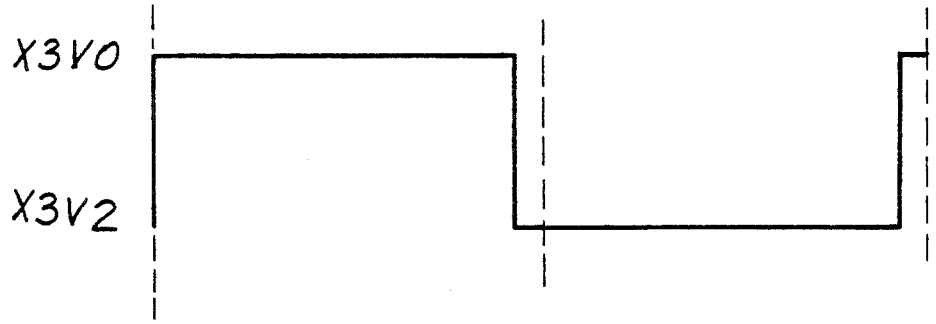
Figure 11D:
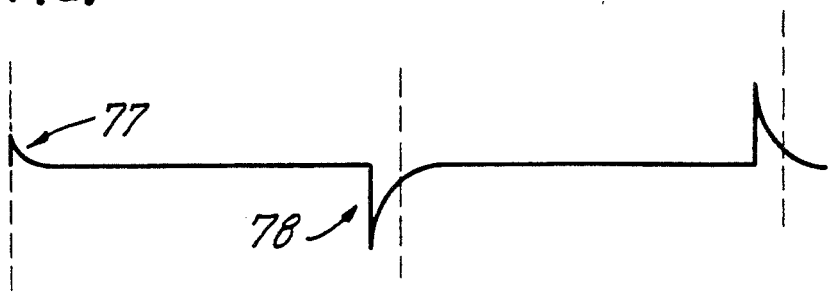

FIGS. 9(*a*) and 9(*b*) show the waveform of a signal voltage applied to signal electrodes X3 and X4 respectively of display 40 in accordance with a second embodiment of the invention. The scanning electrodes are selected as in Example 1. FIGS. 10(*a*) and 10(*b*) show the waveform of combined scanning and signal voltages applied to pixels Y1X3 and Y1X4 respectively. In Example 2, first interval t1=65 μsec, second interval t2=5 μsec, V0−V1=V1−V2=V3−V4=V4−V5=1.49 V and V2−V3=14.10 V.

As shown in FIG. 9(*a*) to select signal electrode X3 during period FRI, a primary selecting voltage V5 is applied during first interval t1 and a secondary non-selecting voltage V3 is applied during second interval t2. When signal electrode X3 is not selected, a primary non-selecting voltage V3 is applied for first interval t1 and a secondary selecting voltage V5 is applied during second interval t2. As shown in FIG. 9(*b*), even when signal electrode X4 is selected for successive selecting periods t0, voltage VX4 decreases to V3 for second interval t2 during each selecting period t0.

Referring to FIGS. 10(*a*) and 10(*b*), when a pixel is selected during period FR1, a primary selecting voltage V0−V5 is applied for first interval t1 and a secondary non-selecting voltage V0–V4 is applied for a second interval t2. Voltage V0–V4 is of sufficient magnitude to activate the pixel. A non-selected pixel will have a voltage equal to V4−V5 or V4−V3 during first interval t1 and the opposite voltage during second interval t2. These voltages will be of magnitude below the threshold magnitude of the liquid crystal cell and the corresponding pixels will remain effectively unselected.

FIG. 11(*a*) and FIG. 11(*c*) show the waveform signal voltages applied to signal electrodes X3 and X4 respectively and FIGS. 11(*b*) and 11(*d*) show crosstalk noise produced a pixel X3Y1 and X4Y1 respectively when liquid crystal panel 40 is activated in accordance with this second embodiment of the invention. FIG. 11(*b*) shows crosstalk noise sent from a signal electrode to a scanning electrode in which adjacent pixels are selected. FIG. 11(*d*) shows crosstalk noise generated when a selected pixel is adjacent to an unselected pixel. As shown in FIGS. 11(*a*) through 11(*d*), a noise 75 is equal in magnitude to a noise 77 and a noise 76 is equal in magnitude to a noise 78. Accordingly, crosstalk noise is uniform throughout display panel 40, pixels X3Y1 and X4Y2 have substantially identical transmittance and crosstalk noise does not generate undesirable localized contrast and brightness variations.

Figure 12:
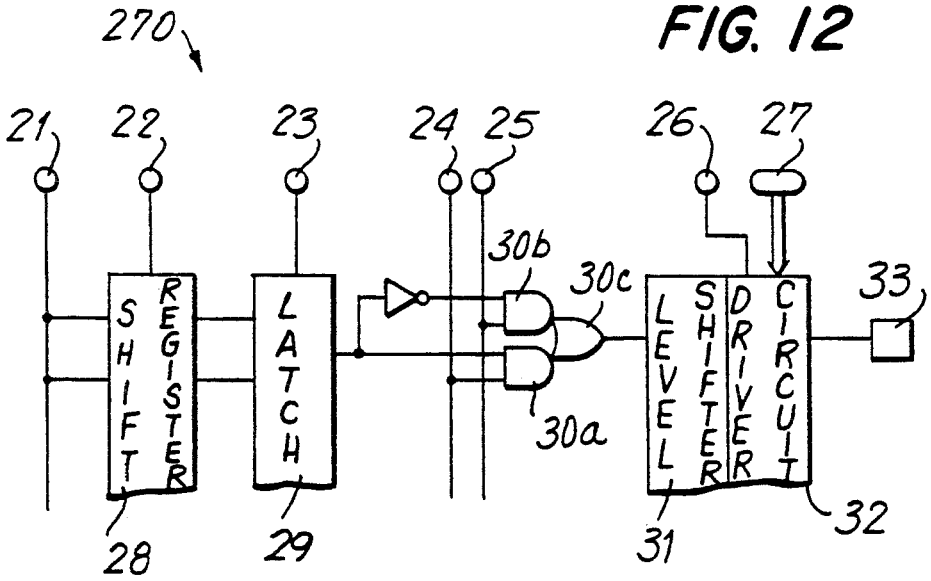
FIG. 12 is a diagram of a circuit for energizing signal electrodes in accordance with the invention.
Figure 13A:
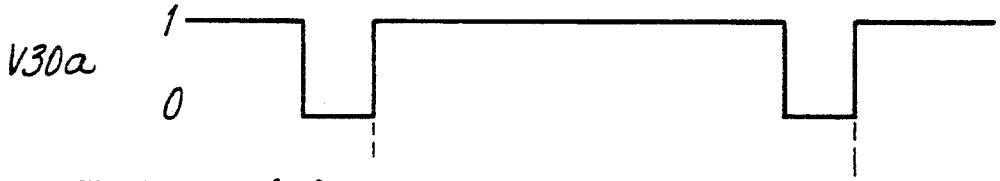
FIGS. 13(*a*) and 13(*b*) are timing diagrams illustrating the waveform of voltage applied to terminals 24 and 25 respectively, of the circuit shown in FIG. 12.
Figure 13B:
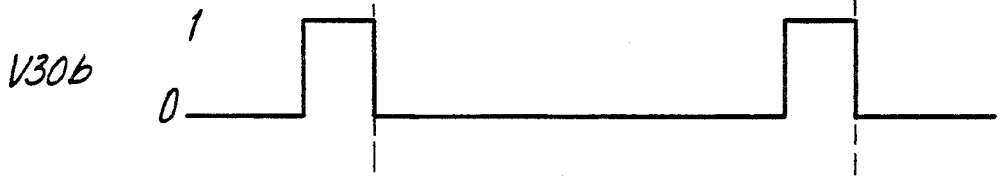
Figure 13C:
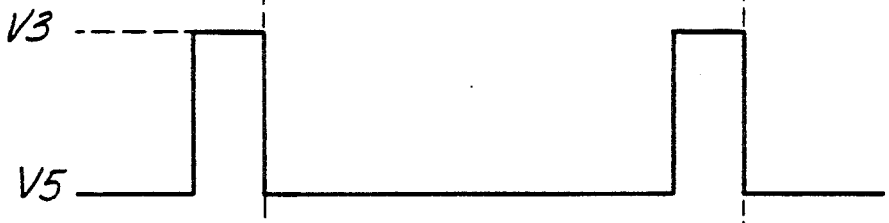
Figure 13D:
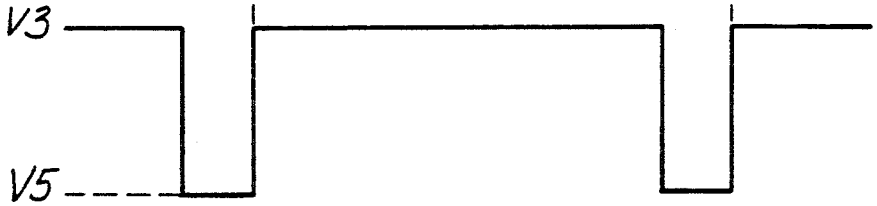

FIG. 12 is a diagram of a circuit 270 for energizing signal electrodes in accordance with the second embodiment of the invention. Circuit 270 is substantially similar to circuit 170. FIGS. 13(*a*), 13(*b*), 13(*c*) and 13(*d*) are timing diagrams of waveforms applied to and produced by circuit 270.

Circuit 270 includes a shift clock input terminal 21 and a data input terminal 22 for receiving data for determining whether a pixel is to be activated to provide a display, both coupled to a shift register 28 for outputting the data. A latch 29 is included to retain data received at input terminal 22 and for converting the data from shift register 28, in serial form, to a parallel form. Latch 29 is controlled by a signal at a latch signal input terminal 23.

Circuit 270 also includes a pair of signal voltage input terminals 24 and 25 for a pair of AND gates 30*a* and 30*b* respectively. A waveform V30*a* and a waveform V30*b* shown in FIGS. 13(*a*) and 13(*b*) respectively are applied to signal voltage input terminal 24 and input terminal 25 respectively. When the data retained in latch 29 is at a high level, the signal of FIG. 13(*a*) is selected. When the data in latch 29 is at a low level, the signal of FIG. 13(*b*) is selected. Accordingly, either the waveform of signal voltage shown in FIG. 13(*c*) or 13(*d*) is output from circuit 270 to each selected pixel during period FRI, depending on the level of latch 29. The waveform of FIG. 13(*c*) is output to a selected pixel and that of FIG. 13(*d*) is output to an unselected pixel.

Circuit 270 also includes a level shifter 31 for converting the power system based on signal voltage input terminal 25 and OR gate 30*c* and a signal electrode driving circuit 32. An inverting terminal 26 for AC driving and a power source 27 for energizing a liquid crystal cell are coupled to signal electrode driving circuit 32 to provide a suitable voltage to a terminal 33 from which the signal electrodes are energized.

As shown in FIGS. 9(*a*), 9(*b*), 10(*a*) and 10(*b*), during activation of liquid crystal panel 40 in accordance with the second embodiment of the invention, when a pixel is selected, a primary selecting voltage is applied for first interval t1 and a secondary non-selecting voltage is applied for second interval t2. When a pixel is not selected, a primary non-selecting voltage is applied for first interval t1 and a secondary selecting voltage is applied for second interval t2. The second embodiment is advantageous because interval t2 can be made extremely short, in this case 5 μsec (about 7% of period t0) while still providing substantially uniform crosstalk noise. The length of second interval t2 must be adjusted so that the manner in which crosstalk is sent from a signal electrode to a scanning electrode does not differ between two signal electrodes in which a first signal electrode has selected pixels and unselected pixels alternately arranged and a second signal electrode has selected or unselected pixels successively arranged.

EXAMPLE 3

Figure 14A:
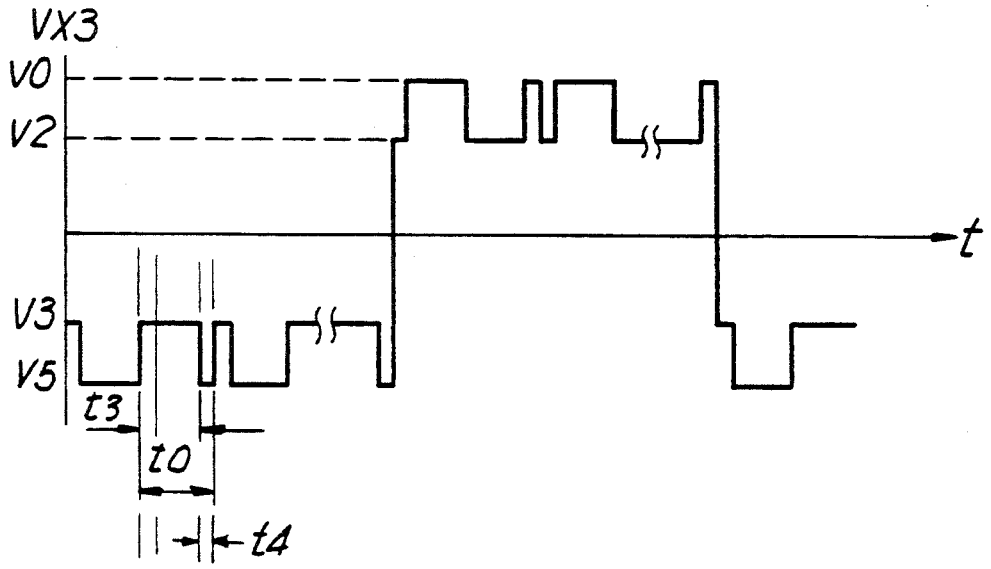
FIGS. 14(*a*) and 14(*b*) are timing diagrams showing the waveform of signal voltages applied to signal electrodes X3 and X4 of the panel shown in FIG. 4 in accordance with a third embodiment of the invention.
Figure 14B:
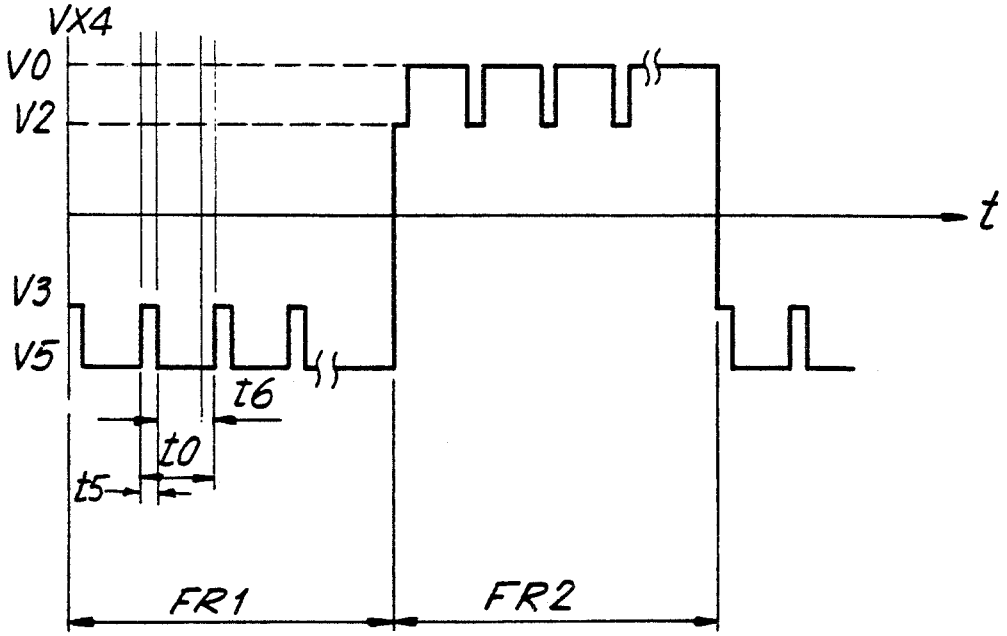
Figure 15A:
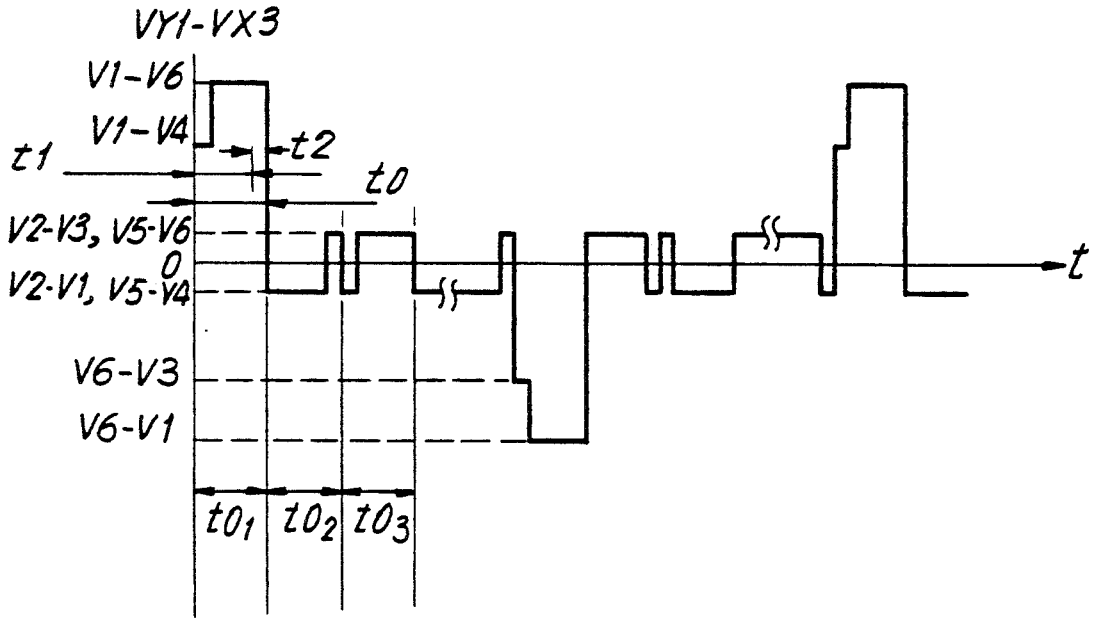
FIGS. 15(*a*) and 15(*b*) are timing diagrams showing the waveforms of combined scanning and signal voltages applied to pixels Y1X3 and Y1X4 of FIG. 4 when the liquid crystal panel of FIG. 4 is activated in accordance with a third embodiment of the invention.
Figure 15B:
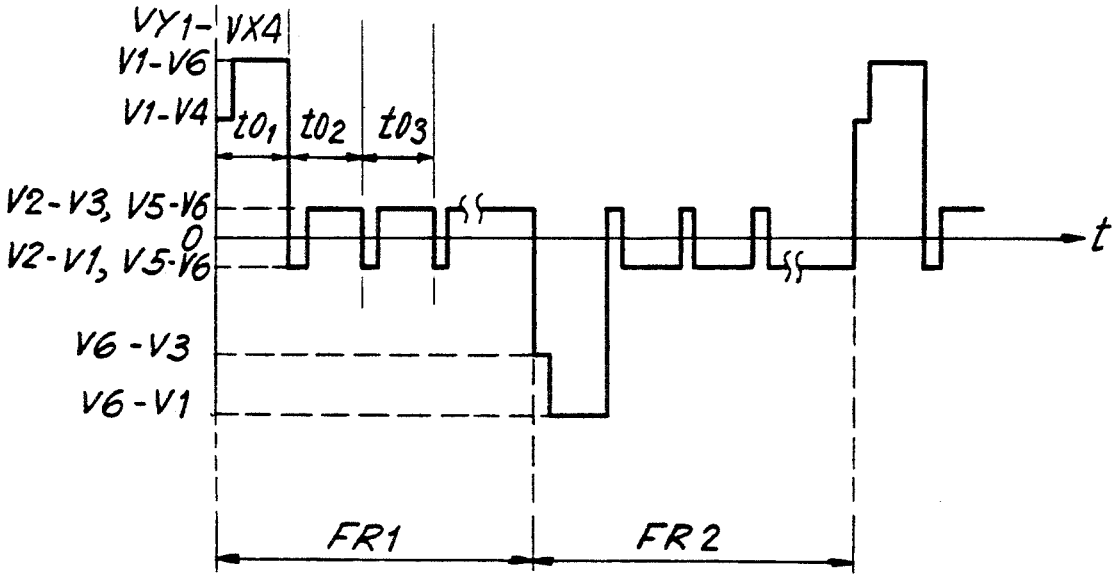
Figure 16A:
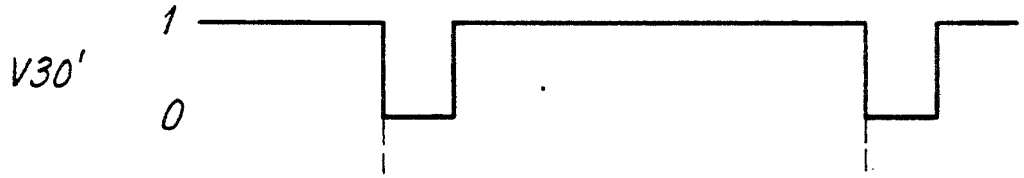
FIGS. 16(*a*) and 16(*b*) are timing diagrams illustrating the waveform of voltage applied to terminals 24 and 25 of the circuit FIG. 12 in accordance with a third embodiment of the invention.
Figure 16B:
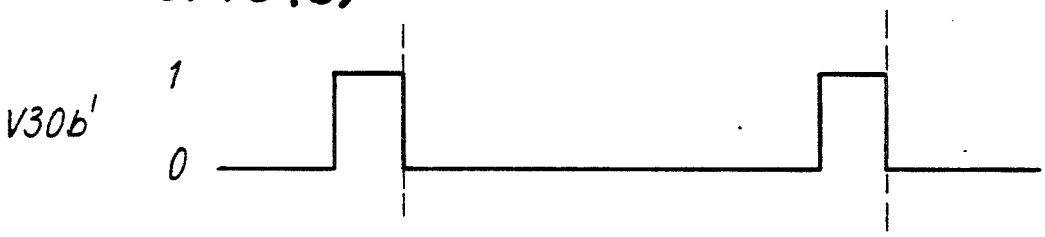
Figure 16C:
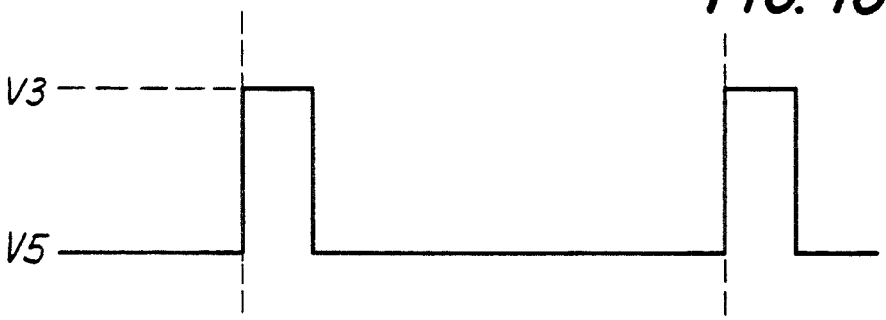
Figure 16D:
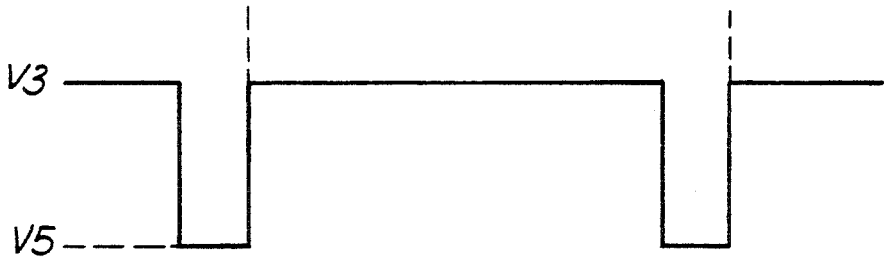
Figure 17A:
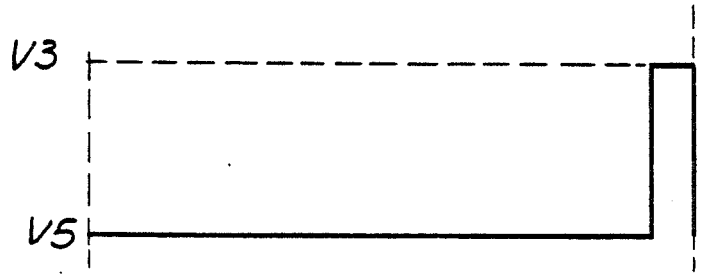
FIGS. 17(*a*), 17(*b*), 17(*c*) and 17(*d*) are timing diagrams of the waveforms of voltages to signal electrodes to provide a gradation contrast display utilizing a pulse modulation technique.
Figure 17B:
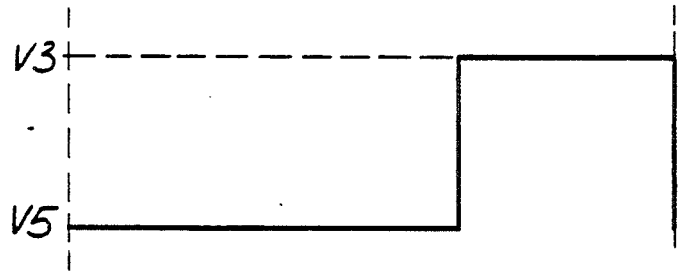
Figure 17C:
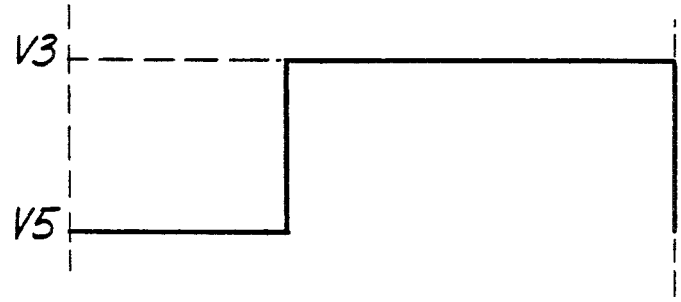
Figure 17D:
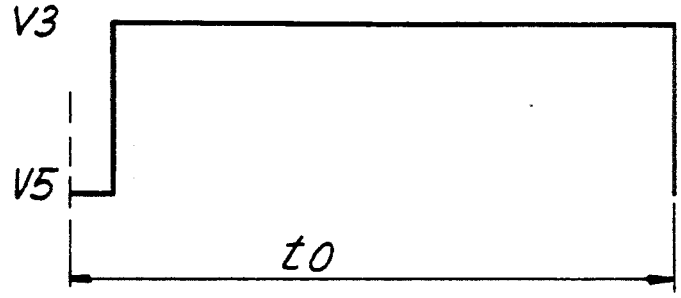

FIGS. 14(*a*) and 14(*b*) are timing diagrams showing the waveforms of signal voltages applied to signal electrodes X3 and X4 in accordance with a third embodiment of the invention. FIGS. 15(*a*) and 15(*b*) show the waveforms of combined scanning and signal voltages at pixels Y1X3 and Y1X4 of liquid crystal panel 40 respectively. The waveform of the voltage applied to the scanning electrodes is the same as in Example 1. First intervals t3=t6=60 μsec and second intervals t4=t=10 μsec and V0−V1=V1−V2=V3−V4=V4−V5=1.45 V. V2−V3=13.85 V.

To activate liquid crystal panel 40 in accordance with this third embodiment, when a pixel is selected, a secondary non-selecting voltage is applied for second interval t5 followed by a primary selecting voltage for first interval t6. When a pixel is not selected the primary non-selecting voltage is applied for first interval t3 followed by a secondary selecting voltage for second interval t4.

Accordingly, when panel 40 is activated in accordance with this embodiment, the instant during a selecting period t0 at which a signal voltage at a signal electrode of an unselected pixel switches from selecting to non-selecting occurs at a different instant than at which a signal voltage at a signal electrode of a selected pixel switches from a non-selecting voltage to a selecting voltage. Consequently, there is decreased chance that crosstalk noise from signal electrodes to a scanning electrodes will cancel out and a crosstalk noise will be uniformly present on the scanning electrodes. Pixels X3Y1 and X4Y1 exhibit substantially identical transmittance.

As shown in FIG. 14(*a*): during a first selecting period $t0_1$, the voltage of signal electrode X3 is non-selecting for second interval t5 and then selecting for first interval t6; during a second selection period $t0_2$, the voltage of signal electrode X3 is non-selecting for first interval t3 and then selecting for second interval t4; and during a third selecting period $t0_3$, signal electrode X3 is non-selecting for second interval t5 and the selecting for first interval t6. During those same first three scanning periods $t0_1$, $t0_2$ and $t0_3$, signal electrode X4 is non-selecting for second interval t5 and then selecting for first interval t6 for each of selecting periods $t0_1$, $t0_2$ and $t0_3$.

The difference of the two waveforms occurs during second selecting period $t0_2$. As shown in FIGS. 15(*a*) and 15(*b*), during second selecting period $t0_2$, pixel Y1X3 is at primary voltage V5−V4 for first interval t3 then at secondary voltage V5−V6 for second interval t4. During the same second selecting interval $t0_2$, pixel Y1X4 is at secondary voltage V5−V4 for second interval t5 and then at primary voltage V5−V6 for first interval t6. Accordingly, the crosstalk noise did not cancel out in pixels X3Y1 and X4Y1, which had substantially identical transmittance.

Pixel Y1X4 is between two selected pixels on scanning electrode Y1 and pixel Y2X4 is between a unselected pixel and a selected pixel on scanning electrode Y2. When panel 40 was activated as described in Examples 1 and 2, a slight difference in transmittance was observed at pixels Y1X4 and Y2X4. However, when panel 40 was activated as in Example 3, pixels Y1X4 and Y2X4 had identical transmittance.

A circuit for energizing the signal electrodes in accordance with the third embodiment contains the same elements as circuit 270 of FIG. 12. A waveform V30*a*′ and a waveform V30*b*′ shown in FIGS. 16(*a*) and 16(*b*) are input to terminals 24 and 25 respectively of NAND gates 30*a* and 30*b*. When the display data retained in latch 29 is at a high level, the signal of FIG. 16(*a*) is selected. When the data is at a low level, the signal of FIG. 16(*b*) is selected. Accordingly, the data in latch 29 controls whether the waveform of FIG. 16(*c*) or FIG. 16(*d*) is applied to the signal electrode. The waveform of FIG. 16(*c*) is the waveform of signal voltages applied to selected pixels during period FR1 and the waveform of FIG. 16(*d*) is the waveform of signal voltages applied to unselected pixels during period FR1.

EXAMPLE 4

In accordance With another embodiment of a liquid crystal panel activation method in accordance with the invention, panel 40 was activated as in Example 3 except that during second interval t5, a secondary intermediate reference voltage was applied rather than a non-selecting voltage. During second interval t4, an intermediate reference voltage was applied as the secondary voltage rather than a selecting voltage. It was found that similar advantages achieved during Example 3 were achieved during Example 4.

EXAMPLE 5

The method for activating a liquid crystal panel in accordance with the invention can be employed with a gradation-type liquid crystal display using the pulse width modulation technique. FIGS. 17(*a*), 17(*b*), 17(*c*) and 17(*d*) show different signal voltage waveforms for activating a gradation display with pulse modulation in which the waveform changes shown occur during one selecting period t0 occurring during period FR2 of Examples 1–4.

FIG. 17(*a*) corresponds to grey level 0, FIG. 17(*b*) corresponds to grey level 1, FIG. 17(*c*) corresponds to grey level 2 and FIG. 17(*d*) corresponds to grey level 3. As shown in these figures, a selecting voltage is applied for the longest duration during grey level 0 and the shortest duration during grey level 3 In this manner, by varying the relative lengths of selecting and non-selecting intervals, gradations of the display can be achieved.

At grey level 0, corresponding to FIG. 17(*a*), the highest effective voltage is applied to a pixel. As the reference number of the grey level increases, the effective voltage applied to the pixels during a selecting period t0 decreases. A different level is created by varying the relative durations of selecting voltage and non-selecting voltage for grey levels 0 and 3. The timing at which a switch is made from the selecting voltage to the non-selecting voltage and from non-selecting voltage to selecting voltage are different for each grey level. Accordingly, it is unlikely that crosstalk noise will cancel out or superimpose and increase so that crosstalk noise occurs uniformly at every grey level regardless of the pattern of the liquid crystal display. Consequently, the display quality will be uniform and of a high quality level. When pulse width modulation is utilized, the activation method in accordance with the invention can be applied independent of the number of grey levels.

EXAMPLE 6

Figures 18A, 18B, 18C, 18D, 18E, 18F, 18G, 18H, 18I, 18J, 18K, 18L, 18M, 18N, 18O, 18P:
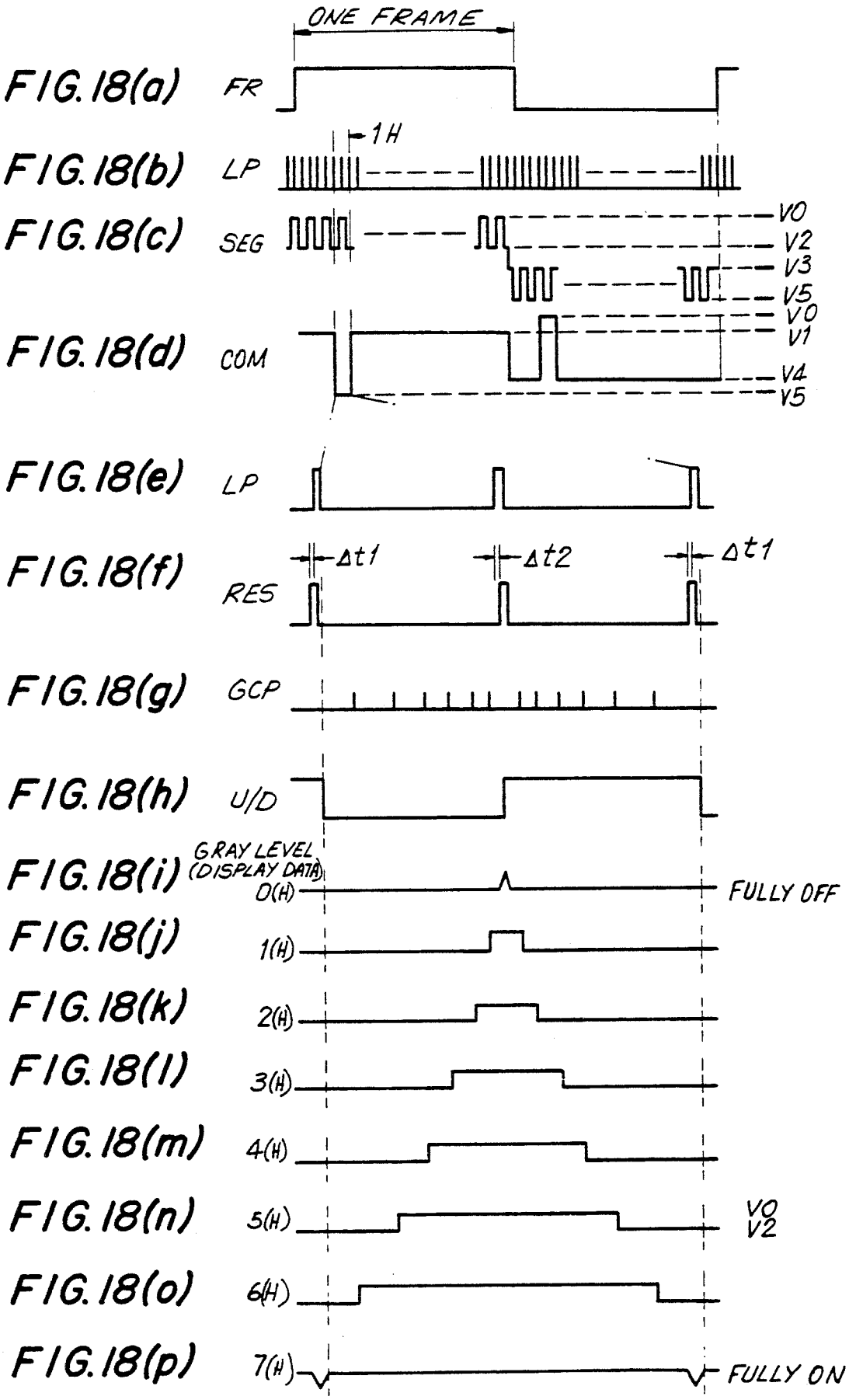
FIGS. 18(*a*) through 18(*p*) are timing diagrams of waveforms of driving voltages to operate the circuit shown in FIG. 19 to provide a contrast gradation display in accordance with a fourth embodiment of the invention.
Figure 19:
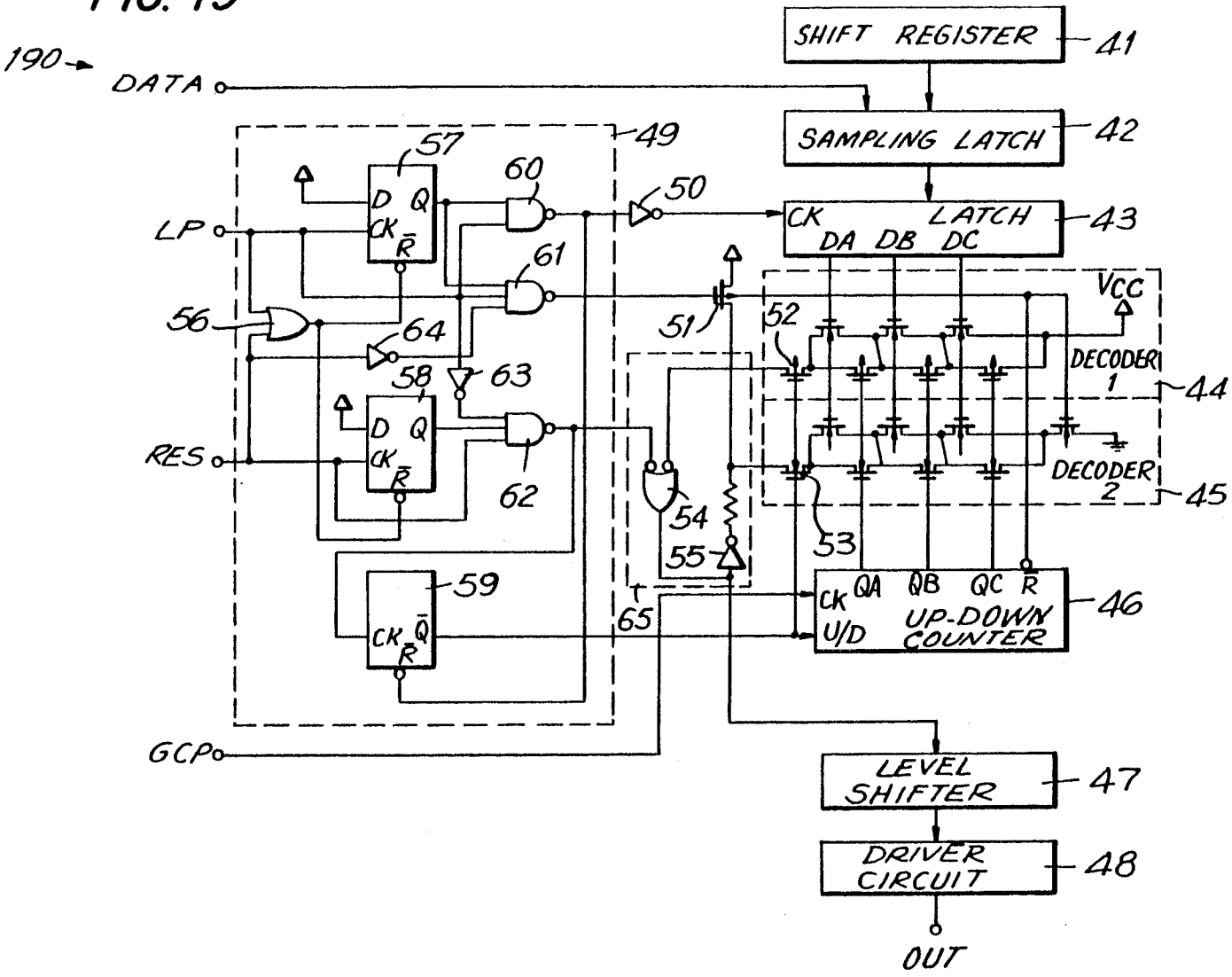
FIG. 19 is a diagram of a circuit for energizing signal electrodes of a contrast gradation display in accordance with a fourth embodiment of the invention.
Figures 21A, 21B, 21C, 21D, 21E, 21F, 21G, 21H:
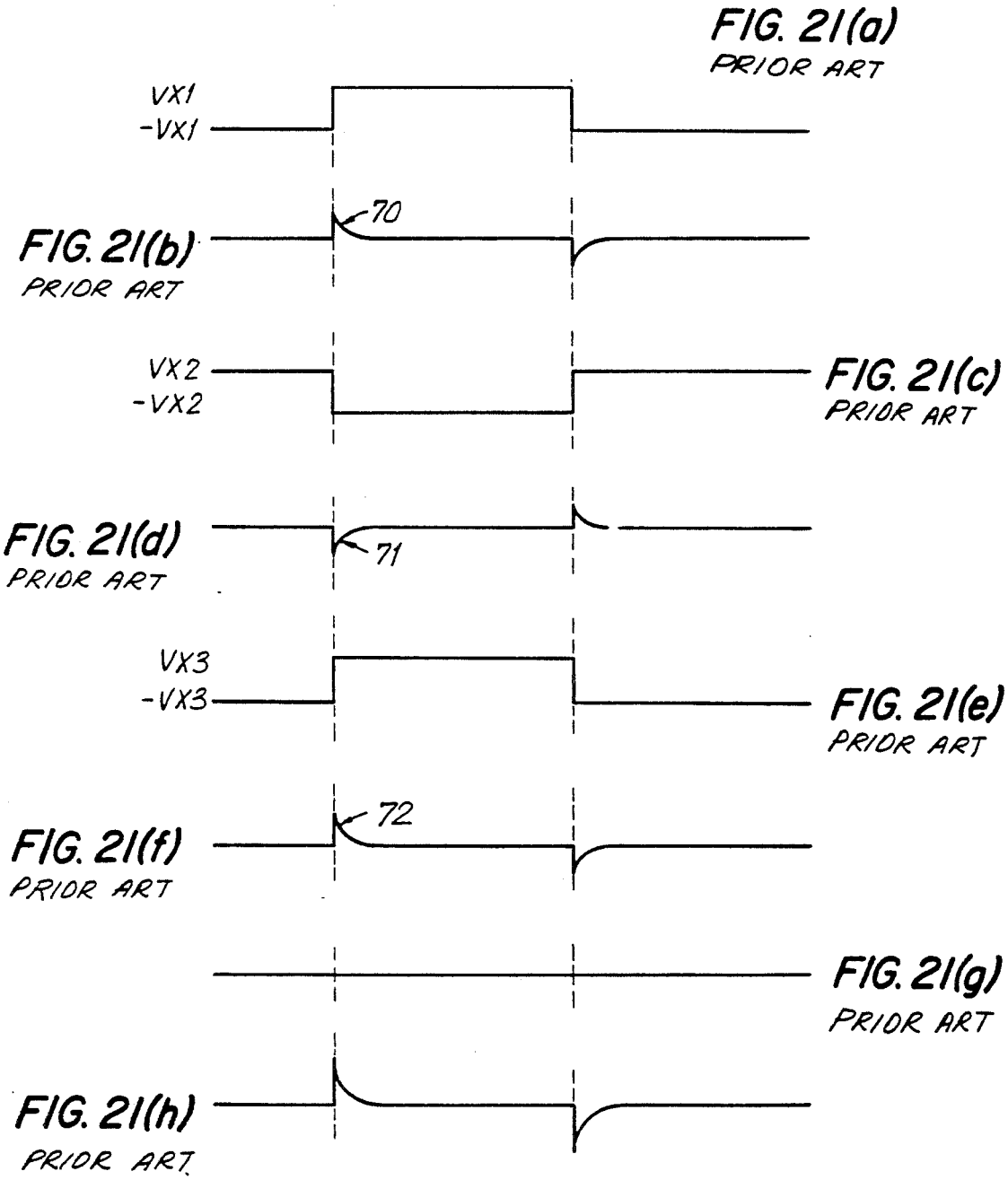
FIG. 21(a) PRIOR ART
FIG. 21(b) PRIOR ART
FIG. 21(c) PRIOR ART
FIG. 21(d) PRIOR ART
FIG. 21(e) PRIOR ART
FIG. 21(f) PRIOR ART
FIG. 21(g) PRIOR ART
FIG. 21(h) PRIOR ART
FIGS. 21(*a*), 21(*c*) and 21(*e*) show waveforms of voltages applied to signal electrodes of the panel of FIG. 20(*a*)

FIGS. 18(*a*) through 18(*p*) show the waveforms of driving voltages for activating a liquid crystal display to provide a gradation-type display including waveforms for activating a circuit 190 shown in FIG. 19 provided for applying a signal voltage to signal electrodes. DATA is clocked into a sampling latch 42 based on the output of a shift register 41. The output of sampling latch 42 is clocked into a latch 43 based on the clock pulses produced by inverting the output of a phase difference detection circuit 49, corresponding to alternate pulses of signal LP. Latch 43 includes output DA, DB and DC which are connected to a first decoder 45 and a second decoder 44. An up-down counter 46 having outputs QA, QB and QC are also connected to first decoder 45 and second decoder 44 for decoding gradation data to provide a signal having the waveforms shown in FIGS. 18(*i*) through 18(*p*) to a level shifter 47 which outputs to a driver circuit 48 which outputs a signal to a signal electrode.

Phase difference detection circuit 49 includes flip flops 57, 58 and 59, NAND gates 60, 61 and 62, inverter 63 and 64 and an OR gate 56. The D inputs of flip flops 57 and 58 are tied to a reference voltage having a high logic level.

The clock inputs of flip flops 57 and 58 receive the LP and RES signals, respectively. The reset terminal ($\overline{R}$) of flip flop 57 receives the output of OR gate 56. Pulse signals LP and RES are supplied as inputs to OR gate 56. The output of OR gate 56 is also supplied to reset terminal $\overline{R}$ of flip flop 58.

The Q output of flip flop 57 and signal LP are supplied as inputs to NAND gate 60 and NAND gate 61. NAND gate 61 also receives inverted RES signals from inverter 64 as a third input. Inverter 63 inverts the LP signal and applies the same to NAND gate 62. The Q output of flip flop 58 and signal RES are also supplied as inputs to NAND gate 62. The output of NAND gate 62 is applied as a clock signal to flip flop 59 and as an inverted input to a NAND gate 54.

The output of NAND gate 60 is supplied to inverter 50 and to reset terminal R of flip flop 59. The $\overline{Q}$ output of flip flop 59 is supplied to the U/D input of up-down counter 46. The output of NAND gate 61 is supplied to a PMOS transistor 51. Clock pulses GCP representing grey level information are supplied to the clock input of up-down counter 46. Depending on the $\overline{Q}$ output of flip flop 59, the value of up-down counter 46 will either be incremented or decremented for each pulse of signal GCP. More particularly, when $\overline{Q}$ of flip flop 59 is at a high logic level the output of up-down counter 46 increases for each clock pulse received. When $\overline{Q}$ of flip flop 59 is at a low logic level, the value of up-down counter 46 decreases for each clock pulse received. The output signals of circuit 190 will have the symmetrical step configuration shown in FIGS. 18(*i*) through 18(*p*).

First decoder 45 and second decoder 44 decode the output of up-down counter 46 in accordance with the output of latch 43 and supply the same as an inverted input to NAND gate 54. The output of NAND gate 54 is supplied as an input to inverter 55 and to level shifter 47. The output of level shifter 47 is provided to a driver circuit 48 which provides a suitable driving signal supplied as the output of circuit 190.

FIG. 18(*a*) shows the waveform of a frame signal for switching the display between a first and second frame, FIG. 18(*b*) shows a waveform of a signal LP which with a signal RES controls when data for the display is supplied from a sampling latch 42 to a latch 43. FIG. 18(*c*) shows signal voltage waveform SEG and FIG. 18(*d*) shows scanning voltage waveform COM for activating a scanning electrode once for one selecting period during each frame. The selecting period of the display corresponds to the time between three pulses of signal LP, shown as interval 1H in FIG. 18(*b*). The reference point for pulse width modulation of the signal electrodes is at the midpoint of one selection period. FIG. 18(*i*) corresponds to a grey level of 7 and FIG. 18(*p*) corresponds to a grey level of 0.

The rising and falling edges of pulse widths of selecting voltages output from circuit 190, shown in FIGS. 18(*i*) through 18(*p*) occur during the pulse widths of lower numbered grey level selecting voltages, during the same selecting periods as shown in FIGS. 18(*i*) through 18(*p*). For example, the rising edge and falling edge representing grey level 5, shown in FIG. 18(*k*) occurs during the pulse width of the signal representing grey level 4, shown in FIG. 8(*l*).

When activating the display by the pulse width modulation method in accordance with this example of the invention, the pulse widths of the selecting voltages are varied at both sides of the leading edge of a signal U/D shown in FIG. 18(*h*), upon which the variation of the pulse widths shown in FIGS. 18(*i*) through 18(*p*) are based.

The instants at which the signal voltage waveforms shown in FIGS. 18(*i*) through 18(*p*) change are essentially outside the waveforms of scanning voltages. Scanning voltage waveforms are essentially the same as in conventional pulse width modulation methods. When a scanning voltage is applied successively to scanning electrodes, a reference voltage is applied to the remaining scanning electrodes.

The pulse width of the signal voltages are modulated according to the desired grey level to provide waveforms such as in FIGS. 18(*i*) through 18(*p*). The instant during a selecting period at which the selecting voltage rises and falls is different for each grey level so that selecting pulses corresponding to high numbered grey levels fall within the interval between instants in which selecting pulses corresponding to low numbered grey levels rise and fall. Phase difference $\Delta t1$, between the leading edge of signal RES and signal LP, adds a minute pulse at the start and end of each grey level 0 interval, shown in FIG. 18(*p*). The phase different $\Delta t2$ between the leading edge of signal LP and signal RES adds a minute pulse at the midpoint of the waveform during each grey level 7 interval shown in FIG. 18(*i*).

During one selecting period, the selecting voltage and the non-selecting voltage are both applied for every grey level but for different relative durations for each grey level. This phase difference can be varied according to the particular characteristics of a liquid crystal cell. In this manner, crosstalk noise is uniform regardless of grey level to yield a high quality display regardless of the pattern of the display.

To operate circuit 190 to produce signal waveforms that are at a non-selecting voltage at both the beginning and end of a selecting period, the signal from shift register 41 causes sampling latch 42 to accept gradation display data from a controller corresponding to one pixel at a time. The gradation data is stored temporarily in sampling latch 42, formed of a plurality of latch circuits and all of the stored data is transmitted to latch 43 at the beginning of one selecting period in response to the output signal from inverter 50 to the CK input terminal of latch 43.

Periods $\Delta t1$ and $\Delta t2$ ar determined according to the phase difference between signals LP and RES by a phase difference detection circuit 49. Whether an internal signal is produced or is not produced depends on the relationship of the time at which signal LP rises and the time at which signal RES rises. When signal LP rises earlier than signal RES, $\Delta t2$ occurs. When signal RES rises before signal LP, $\Delta t1$ occurs. The times $\Delta t1$ and $\Delta t2$ can be controlled independently. If the relationship $\Delta t1 = \Delta t2$ occurs, phase difference detection circuit 49 can be simplified in design.

Phase difference detection circuit 49 prevents inverter 50 from outputting the signal to input terminal CK of latch 43 when signal LP is applied at a point intermediate one selection period because the leading edge of signal RES will trail the leading edge of signal LP and flip-flop 57 will be reset during that pulse or signal LP.

The gradation data stored in latch 43 during one selection period is output to a first decoder 45 and a second decoder 44. The decoder portion corresponds to one bit of the output from a driver. Decoder 45 and decoder 44 are formed of a series-parallel combination of an NMOS transistor and a PMOS transistor. Each decoder produces either a setting output or a resetting output to select drivers. Because first decoder 45 and second decoder 44 are formed from a single channel transistor, a loop 65 having a NAND gate 54 and an inverter 55 is reset by PMOS transistor 51 at the beginning of a selecting period. Accordingly, the outputs from the drivers are non-selecting outputs.

A series of clock pulses for gradation weighing, shown in FIG. 18(*g*) as signal GCP, are applied to up/-down counter 46 such as standard IC LS 191. When the counter output complementary to the data for the display is applied to the first decoder, the first decoder turns on (conducts). The output from NAND gate 54 attains a high logic level 1 and is retained in that state. The outputs from first decoder 45 and second decoder 44 are selectively delivered by an NMOS transistor 53 and a transistor 52 which are gated by the output from flip flop 59.

When transistor 53 becomes conductive, the up/-down counter 46 acts as an up counter. The output impedance of inverter 55 is made high compared to the output from decoder 44 and decoder 45. If either decoder 45 or decoder 44 conducts, the state of loop 65 is urged to follow the output from the conducting decoder. The output from NAND gate 62 is input to NAND gate 54. When the output from gate 62 is an OFF signal, NAND gate 62 produces a selecting signal during period Δt2 during which signal LP does not induce latch action so that data for a new selecting period is transferred.

During interval Δt1, at the beginning of a selection period, the output from NAND gate 62 is an ON signal and PMOS transistor 51 makes the output from NAND gate 54 a non-selecting voltage. Because first decoder 45 is conducting during interval Δt1 the non-selecting voltage is delivered from the driver only during period Δt1.

The output $\overline{Q}$ from flip-flop 59 distinguishes between the operation performed in the former half of one selection period before Δt2 and the operation performed in the latter half of a selection period after Δt2. When the output $\overline{Q}$ is high, up/down counter 46 acts as an up counter and operates the first decoder 45. When output $\overline{Q}$ is low, counter 46 acts as a down counter and operates second decoder 44.

Once either first decoder 45 or second decoder 44 outputs a signal, the condition is maintained. Therefore, a pulse width modulated output starting from an intermediate point at Δt2 in one selection period is obtained as shown in FIGS. 18(*i*) through 18(*p*). This output is converted into an appropriate voltage by driver circuit 48 which receives a signal from level shifter 47 so that the liquid crystal cells of the panel will have sufficient driving voltage.

Circuit 190 is capable of displaying 8 grey levels through 7, as shown in FIGS. 18(*i*) through 18(*p*) respectively. The activation method in accordance with this example can be modified to display a different number of grey levels by either increasing or decreasing the number of series transistors in each of the first and second decoders The invention accordingly provides a method of activating a liquid crystal display formed of a base sheet, a layer of liquid crystal material on the base sheet and an upper base sheet on the liquid crystal material. The upper and lower base sheets are provided with orthogonal scanning and signal electrodes and liquid crystal pixels are formed at intersections of the scanning electrode and signal electrodes.

To activate the liquid crystal panel in accordance with the invention, a scanning voltage is applied successively to the scanning electrodes for successive selecting periods and signal voltage waveforms are selectively applied to the signal electrodes. To select a pixel at the intersection of a scanning electrode and a signal electrode, a selecting voltage is applied to the signal electrode for a first time interval during the selecting period in which a selecting voltage is applied to the scanning electrode.

To prevent nonuniform crosstalk noise from occurring throughout the display, the voltage to each signal electrode is not constant during each selection period. If a pixel is selected, the a secondary voltage will also be applied during the selecting period. The secondary voltage can be a reference voltage or a non-selecting voltage. If a pixel is not selected, the primary voltage applied to the signal electrode for that pixel will be a non-selecting voltage as well as either a reference voltage or a selecting voltage for a second time interval during that selecting period. By varying the signal voltage to a pixel during each selection period, crosstalk noise sent from the signal electrodes to the scanning electrodes are made homogeneous throughout the display. This greatly reduces local contrast variations, independent of a particular pattern of displayed pixels. Accordingly, the readability of the display and display quality are accordingly improved.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method of activating a liquid crystal display including scanning electrodes and signal electrodes with liquid crystal material therebetween and having pixels at intersections between the scanning electrodes and the signal electrodes, comprising:

applying a scanning voltage successively to the scanning electrodes, successive applications of the scanning voltage occurring in successive selecting periods, each selecting period representing the time interval during which a selecting voltage is applied to one of the scanning electrodes, and applying to the signal electrodes corresponding to selected pixels during the selecting period a selecting voltage having a primary selecting magnitude for a first time interval and a second selecting voltage of a different magnitude for a second time interval; and applying to the signal electrodes corresponding to non-selected pixels during a selecting period a non-selecting voltage having a primary non-selecting magnitude for a third time interval and a secondary non-selecting voltage of a different magnitude for a fourth time interval.

2. The method of claim 1, wherein the first interval is longer than the second interval and the third interval is longer than the fourth interval.

3. The method of claim 2, wherein the third interval is equal to the first interval and the fourth interval is equal to the second interval.

4. The method of claim 2, wherein the first interval is different than the third interval and the second interval is different than the fourth interval.

5. The method of claim 3, wherein the first interval occurs before the second interval during a selecting period and the third interval occurs before the fourth interval during a selecting period.

6. The method of claim 3, wherein the second interval occurs before the first interval and the fourth interval occurs before the third interval.

7. The method of claim 1, wherein the secondary voltage applied to the signal electrodes corresponding to selected pixels is the primary non-selecting voltage applied to the signal electrodes corresponding to non-selected pixels and the secondary voltage applied to the signal electrodes corresponding to nonselected pixels is the primary selecting voltage applied to the signal electrodes corresponding to selected pixels.

8. The method of claim 2, wherein the secondary voltage applied to the signal electrodes corresponding to selected pixels is the primary non-selecting voltage applied to the signal electrodes corresponding to non-selected pixels and the secondary voltage applied to the signal electrodes corresponding to non-selected pixels is the primary selecting voltage applied to the signal electrodes corresponding to selected pixels.

9. The method of claim 3, wherein the secondary voltage applied to the signal electrodes corresponding to selected pixels is the primary non-selecting voltage applied to the signal electrodes corresponding to non-selected pixels and the secondary voltage applied to the signal electrodes corresponding to non-selected pixels is the primary selecting voltage applied to the signal electrodes corresponding to selected pixels.

10. The method of claim 5, wherein the secondary voltage applied to the signal electrodes corresponding to selected pixels is the primary non-selecting voltage applied to the signal electrodes corresponding to non-selected pixels and the secondary voltage applied to the signal electrodes corresponding to non-selected pixels is the primary selecting voltage applied to the signal electrodes corresponding to selected pixels.

11. The method of claim 2, wherein the voltage applied during the second and fourth intervals is a reference voltage intermediate the primary selecting and primary non-selecting voltage.

12. The method of claim 3, wherein the voltage applied during the second and fourth intervals is a reference voltage intermediate the primary selecting and primary non-selecting voltage.

13. The method of claim 5, wherein the voltage applied during the second and fourth intervals is a reference voltage intermediate the primary selecting and primary non-selecting voltage.

14. The method of claim 1, wherein the first interval occurs before the second interval and the fourth interval occurs before the third interval.

15. The method of claim 7, wherein the first interval occurs before the second interval and the fourth interval occurs before the third interval.

16. The method of claim 1, wherein the second interval occurs before the first interval and the third interval occurs before the fourth interval.

17. The method of claim 7, wherein the second interval occurs before the first interval and the third interval occurs before the fourth interval.

18. The method of claim 14, wherein the first interval is equal to the third interval and the second interval is equal to the fourth interval.

19. The method of claim 1, wherein the secondary voltage applied to the signal electrodes corresponding to selected pixels is greater than or equal to the minimum magnitude of signal voltage required to activate a selected pixel and the secondary voltage applied to the signal electrodes corresponding to non-selected pixels is less than or equal to the maximum magnitude of signal voltage which will not activate a non-selected pixel.

20. The method of claim 3, wherein the secondary voltage applied to the signal electrodes corresponding to selected pixels is greater than or equal to the minimum magnitude of signal voltage required to activate a selected pixel and the secondary voltage applied to the signal electrodes corresponding to non-selected pixels is less than or equal to the maximum magnitude of signal voltage which will not activate a non-selected pixel.

21. The method of claim 5, wherein the secondary voltage applied to the signal electrodes corresponding to selected pixels is greater than or equal to the minimum magnitude of signal voltage required to activate a selected pixel and the secondary voltage applied to the signal electrodes corresponding to non-selected pixels is less than or equal to the maximum magnitude of signal voltage which will not activate a non-selected pixel.

22. The method of claim 14, wherein the secondary voltage applied to the signal electrodes corresponding to selected pixels is greater than or equal to the minimum magnitude of signal voltage required to activate a selected pixel and the secondary voltage applied to the signal electrodes corresponding to non-selected pixels is less than or equal to the maximum magnitude of signal voltage which will not activate a non-selected pixel.

23. The method of claim 16, wherein the secondary voltage applied to the signal electrodes corresponding to selected pixels is greater than or equal to the minimum magnitude of signal voltage required to activate a selected pixel and the secondary voltage applied to the signal electrodes corresponding to non-selected pixels is less than or equal to the maximum magnitude of signal voltage which will not activate a non-selected pixel.

24. The method of claim 3, wherein the first interval is about 6/7 of the selecting period and the second interval is about 1/7 of the selecting period

25. The method of claim 5, wherein the first interval is about 6/7 of the selecting period and the second interval is about 1/7 of the selecting period.

26. The method of claim 19, wherein the first interval is about 6/7 of the selecting period and the second interval is about 1/7 of the selecting period.

27. The method of claim 7, wherein the first and third intervals are about 6.5/7 of the selecting period and the second and fourth intervals are about 0.5/7 of the selecting period.

28. The method of claim 9, wherein the first and third intervals are about 6.5/7 of the selecting period and the second and fourth intervals are about 0.5/7 of the selecting period.

29. The method claimed in claim 1, wherein in applying a selecting voltage to the signal electrodes corresponding to selected pixels during the selecting period, the secondary voltage of the selecting voltage is of lower magnitude than the primary selecting magnitude.

30. The method as claimed in claim 29, wherein in applying a non-selecting voltage to the signal electrodes corresponding to non-selected pixels during a selecting period, the secondary voltage of the non-selecting voltage is of higher magnitude than the primary non-selecting magnitude.

31. A method of activating a gradation-type liquid crystal display including scanning electrodes and signal electrodes and having liquid crystal cell pixels at intersections of the scanning electrodes and the signal electrodes, the display constructed so that the percentage of a selecting period for which a selected pixel receives a selecting-type voltage is proportional to the effective grey constant level of the pixel, comprising:

applying a scanning voltage successively to the scanning electrodes, successive applications of the scanning voltage occurring in successive selecting periods, each selecting period representing the time interval during which a selecting voltage is applied to one of the scanning electrodes; and applying a selecting-type high magnitude voltage to signal electrodes for a primary interval and a non-selecting-type low magnitude voltage to said signal electrodes for a secondary interval, the primary and secondary intervals falling within the selecting period, whereby the relative duration of the primary and secondary intervals determines the contrast grey level of the pixel.

32. The method of claim 31, wherein the primary interval occurs before the secondary interval.

33. The method of claim 31, wherein the secondary interval occurs before the primary interval.

34. The method of claim 31, wherein the low magnitude voltage is applied to a pixel for one half of the secondary interval then the high magnitude voltage is applied for the primary interval and then the low magnitude voltage is applied to the pixel for the remainder of the selecting period for one half of the secondary interval.

35. The method of claim 31, wherein the high magnitude voltage is applied to a pixel for one half of the primary interval then the low magnitude voltage is applied for the secondary interval and then the high magnitude voltage is applied to the pixel for the remainder of the selecting period for one half of the primary interval.

36. The method of claim 31, wherein the ratio of the primary and secondary intervals can have up to four different values during activation of the display.

37. The method of claim 34, wherein the ratio of the primary and secondary intervals can have up to eight different values during activation of the display.

38. The method of claim 31, wherein at least one minute pulse is produced having each selection period at maximum and minimum grey levels.

39. A liquid crystal display device, comprising:

a matrix of liquid crystal cells including scanning electrodes, signal electrodes intersecting the scanning electrodes to define pixels and liquid crystal material between the scanning and signal electrodes;

scanning signal means for successively applying a scanning electrode waveform to the scanning electrodes so that successive applications of the scanning voltage occurs in successive selecting periods, each selecting period representing the time interval during which a selecting voltage is applied to one of the scanning electrodes; and signal voltage means for applying a signal voltage waveform to the signal electrodes so that if a pixel is to be selected during the selecting period, the signal electrode corresponding to the selected pixel during the selecting period will receive a primary selecting voltage of primary selecting magnitude for a first interval of the selecting period and a secondary selecting voltage of different magnitude for a second interval of the selecting period and when a pixel is to be non-selected during a selecting period, the signal electrode corresponding to the non-selected pixel will receive a primary non-selecting voltage of non-selecting magnitude for a third interval of the selecting period and a secondary non-selecting voltage of different magnitude for a fourth interval of the selecting period.

40. The liquid crystal display device of claim 39, wherein the signal voltage means includes waveform supply means for supplying a selecting waveform and a non-selecting waveform and waveform selecting means for discriminating between the selecting waveform and non-selecting waveform to selectively supply only one of the selecting and non-selecting waveform voltages to the signal electrode.

41. The liquid crystal display device of claim 40, wherein the waveform selecting means includes shift register means for receiving pixel selecting and non-selecting data and outputting the pixel data in serial form and latch means for receiving the output from the shift register means and outputting the information in parallel form.

42. The liquid crystal display device of claim 41, wherein the signal from the latch means determines which of the selecting voltage waveform and non-selecting voltage waveform is supplied.

43. The device as claimed in claim 39, wherein the secondary voltage during the second interval is of lower magnitude than the primary selecting magnitude.

44. The device as claimed in claim 43, wherein the secondary voltage during the fourth interval is of higher magnitude than the non-selecting magnitude of the primary non-selecting voltage.

45. A gradation type liquid crystal display device, comprising:

a matrix of gradation-type liquid crystal pixels including a plurality of scanning electrodes, and a plurality of signal electrodes, the scanning electrodes intersecting the signal electrodes to define each pixel;

liquid crystal material between the scanning and signal electrodes;

scanning means for applying a selecting voltage successively to the scanning electrodes so that applications of the selecting voltage occurs during successive selecting periods, each selecting periods representing the time interval during which a selecting voltage is applied to one of the scanning electrodes; and signal means for applying a signal voltage waveform to the signal electrodes so that the signal electrodes will be at a first logic level at the beginning of a selecting period for an initial time interval of the selecting period, a second logic level for a middle interval of the selecting period and at the first logic level for an end interval of the selecting period.

46. The gradation-type liquid crystal display device of claim 41, wherein the waveform applied from the signal means to the signal electrodes is symmetrical about a midpoint of each selecting period.

47. The gradation-type liquid crystal display device of claim 46, wherein the first logic level corresponds to an unselecting-type low magnitude voltage and the second logic level corresponds to a selecting type high magnitude voltage.

48. The gradation-type liquid crystal display device of claim 46, wherein the signal means includes a first pulse signal means for providing a first pulsed signal, second pulse signal means for providing a second pulse signal, the first and second pulse signals having twice the frequency of a selecting period and being out of phase with each other, and phase detection means responsive to the first and second pulse signals, the phase detection means outputting a signal corresponding to alternate pulses of the first pulsed signal.

49. The gradation-type liquid crystal display device of claim 46, wherein the signal means includes decoder means for receiving grey level data and converting the data into a waveform having an appropriate ratio of initial interval to middle interval.

50. The gradation-type liquid crystal display device of claim 49, wherein the decoder means includes up-down counter means for providing a symmetrical signal voltage waveform.

51. The gradation type liquid crystal display device as claimed in claim 45, wherein the second logic level is of greater magnitude than the first logic level.

* * * * *